US009335103B1

(12) United States Patent
Barbely et al.

(10) Patent No.: US 9,335,103 B1
(45) Date of Patent: May 10, 2016

(54) AIR HANDLING UNIT WITH INTERNAL SUPPORT SYSTEM

(71) Applicant: Mitsubishi Electric Corporation, Tokyo (JP)

(72) Inventors: Allen Peter Barbely, Auburn, GA (US); Joseph Paul Bush, Suwanee, GA (US); Peter Christian Flynn, Suwanee, GA (US)

(73) Assignee: Mitsubishi Electric Corporation, Tokyo (JP)

( * ) Notice: Subject to any disclaimer, the term of this patent is extended or adjusted under 35 U.S.C. 154(b) by 21 days.

(21) Appl. No.: 14/528,090

(22) Filed: Oct. 30, 2014

(51) Int. Cl.
*A47B 77/08* (2006.01)
*F28F 9/00* (2006.01)
*A47B 81/00* (2006.01)

(52) U.S. Cl.
CPC ..... *F28F 9/001* (2013.01); *A47B 81/00* (2013.01)

(58) Field of Classification Search
CPC ..... F28F 9/001; F24F 13/20; A47B 31/02
See application file for complete search history.

(56) References Cited

U.S. PATENT DOCUMENTS 4,596,285 A * 6/1986 Dinulescu ..... F28F 3/083 165/166
4,997,034 A * 3/1991 Steffen ..... B64G 1/50 165/104.33
5,485,878 A * 1/1996 Derks ..... F24F 13/20 165/137
5,870,868 A * 2/1999 Kita ..... E04C 2/384 312/140
6,205,738 B1 * 3/2001 Chen ..... E04C 3/28 312/265.4
7,757,510 B2 * 7/2010 Rosete ..... F24F 3/0442 312/257.1
2007/0169500 A1 * 7/2007 Rios ..... F24F 13/222 62/285
2007/0261345 A1 * 11/2007 Janka ..... F24F 13/20 52/404.1
2007/0296315 A1 * 12/2007 Francisquini ..... F24F 1/022 312/236
2011/0232860 A1 * 9/2011 Lackie ..... F24F 3/0442 165/59
2011/0284185 A1 * 11/2011 Cullen ..... F24F 1/0029 165/104.11
2012/0276836 A1 * 11/2012 Stewart ..... F24F 13/20 454/251
2014/0332189 A1 * 11/2014 Amick ..... F24F 13/20 165/121
2015/0034290 A1 * 2/2015 Mercer ..... F24F 13/20 165/177
2015/0082826 A1 * 3/2015 Santini ..... F24F 13/20 62/426
2015/0111485 A1 * 4/2015 Son ..... F24F 3/044 454/284

* cited by examiner

*Primary Examiner* — Hanh V Tran
(74) *Attorney, Agent, or Firm* — Posz Law Group, PLC

(57) ABSTRACT

An air handling unit, includes: an outer casing defining an air passage from a first opening on a first side of the outer casing to a second opening on a second side of the outer casing; a first supporting member in the air passage and affixed to the outer casing; a heat-exchanging coil affixed to a surface of the first supporting member facing the second opening; a second supporting member located such that the heat-exchanging coil is located between the first supporting member and the second supporting member; a first connection member connecting the first supporting member and the second supporting member; and insulation material adjacent to the outer casing at least between the first supporting member and the second opening, the insulation material being located between the first connection member and the outer casing, wherein the insulation material is unperforated between the first supporting member and the second opening.

21 Claims, 19 Drawing Sheets

AIR HANDLING UNIT WITH INTERNAL SUPPORT SYSTEM

TECHNICAL FIELD

The present invention relates generally to air handling units that include a plurality of shelves formed in an outer casing. More particularly, the present invention relates to a structure to securely fasten the shelves to the outer casing without interfering with any insulation in the air handling unit.

BACKGROUND

All air handlers, manufactured for both residential and commercial use, have the same distinct components: a fan or blower to move the air, a heat-exchanging coil to cool the air, and an outer casing to enclose the blower and the heat-exchanging coil. Most modern air handlers also include some kind of electronic control unit. In addition, there is typically a shelf or cross-member in the outer casing provided to support each of these main components.

The heat-exchanging coil is placed at a first end of the air handler, with the blower next to it. In operation, the blower pulls air from an inlet at one end of the air handler, and through the heat-exchanging coil, which cools or warms the air. Then the blower blows the cool or warm air out through an outlet on the other end of the air handler. As a result, the entire inside of the housing is cool or warm, and needs to be insulated.

The shelves that support the blower and the heat-exchanging coil are typically attached to the outer casing with fasteners, such as screws or bolts, which pass through the wall of the outer casing as well as any insulation between the components and the area outside the outer casing. In fastening the shelves to the outer casing by the fasteners, the insulation gotten stuck between the shelves and the outer casing will be compacted in the vicinity of the fastener. This reduces the effectiveness of the insulation, causing local temperature differentials. It is inefficient. In addition, it can provide locations for the formation of condensate if the air is cooled. In particular, condensate can form on the fasteners, especially if the units are installed in high-humidity and high-temperature areas.

It would therefore be desirable to provide a way of securing a blower and a heat-exchanging coil to an outer casing without providing areas of temperature differential, or locations where condensate can easily form.

SUMMARY

An air handling unit is provided, including: an outer casing that defines an air passage for air passing through from a first opening on a first side of the outer casing to a second opening on a second side of the outer casing; a first supporting member placed in the air passage and affixed to the outer casing by a first attachment element; an heat exchanging coil attached to side of the second opening of first supporting member; a second supporting member placed in the air passage such that the heat exchanging coil is located between the first supporting member and the second supporting member; a third supporting member configured to connect the first supporting member to second supporting member; and insulation material located inside the air passage and adjacent to the outer casing, the insulation material being further located between the outer casing and the third supporting member, the insulation material being located adjacent to the outer casing at least between the first supporting member and the second opening.

An air handling unit is provided, including: an outer casing that defines an air passage for air passing from a first opening on a first side of the outer casing to a second opening on a second side of the outer casing; a first supporting member placed in the air passage and affixed to the outer casing; a heat-exchanging coil located in the air passage and affixed to a surface of the first supporting member facing the second opening; a second supporting member placed in the air passage such that the heat-exchanging coil is located between the first supporting member and the second supporting member; a first connection member configured to connect the first supporting member and the second supporting member; and insulation material located inside the air passage and adjacent to the outer casing at least between the first supporting member and the second opening, the insulation material being further located between the first connection member and the outer casing, wherein the insulation material is unperforated between the first supporting member and the second opening.

In some embodiments, the third supporting member may be formed of steel, or aluminum.

In some embodiments, the insulation material may be made of a flexible, closed-cell elastomeric compound.

In some embodiments, the second support member will not be affixed to the outer casing.

In some embodiments, the casing insulation material will be located only between the first supporting member and the second opening.

In some embodiments, the third supporting member will be bent at an angle, the third supporting member will be affixed to the first supporting member, proximate to an intersection of a first side of the first supporting member and a second side of the first supporting member, the first and second sides of the first supporting member being adjacent to each other, and the third supporting member will be affixed to the second supporting member, proximate to an intersection of a first side of the second supporting member and a second side of the second supporting member, the first and second sides of the second supporting member being adjacent to each other.

The air handling unit may further include a fourth supporting member configured to connect the first supporting member to the second supporting member.

In some embodiments, the third supporting member will be affixed to the first supporting member, proximate to a first side of the first supporting member, and is affixed to the second supporting member, proximate to a first side of the second supporting member, the fourth supporting member will be affixed to the first supporting member, proximate to a second side of the first supporting member, and is affixed to the second supporting member, proximate to a second side of the second supporting member, the first side of the first supporting member will be formed opposite to the second side of the first supporting member, and the first side of the second supporting member will be formed opposite to the second side of the second supporting member.

In some embodiments, the third supporting member will be affixed to the first supporting member, proximate to a first side of the first supporting member, and is affixed to the second supporting member, proximate to a first side of the second supporting member, the fourth supporting member will be affixed to the first supporting member, proximate to a second side of the first supporting member, and is affixed to the second supporting member, proximate to a second side of the second supporting member, the first side of the first supporting member will be formed adjacent to the second side of the first supporting member, and the first side of the second supporting member will be formed adjacent to the second side of the second supporting member.

In some embodiments, the fourth supporting member will be bent at an angle, the fourth supporting member will be affixed to a third side of the first supporting member and a fourth side of the first supporting member, the third and fourth sides of the first supporting member being adjacent to each other, and the fourth supporting member will be affixed to a third side of the second supporting member and a fourth side of the second supporting member, the third and fourth sides of the second supporting member being adjacent to each other.

The air handling unit may further include a cross-brace connected between the third support member and the fourth support member.

An air handling unit is provided, including: an outer casing that defines an air passage for air passing from a first opening on a first side of the housing to a second opening on a second side of the outer casing; a first shelf placed in the air passage and affixed to the outer casing; a heat-exchanging coil located in the air passage and affixed to a surface of the first shelf facing the second opening; a second shelf placed in the air passage such that the heat-exchanging coil is located between the first shelf and the second shelf; a first rigid support strap configured to connect the first shelf to the second shelf; and insulation material located inside the air passage and adjacent to the outer casing at least between the first shelf and the second opening, the insulation material being further located between the first rigid support strap and the outer casing, wherein the insulation material is unperforated between the coil shelf and the second opening. In some embodiments, the third supporting member will be formed of steel or aluminum.

In some embodiments, the insulation material will be a flexible, closed-cell elastomeric compound.

In some embodiments, the second shelf will not be affixed to the outer casing.

In some embodiments, the insulation material will be located only between the first shelf and the second opening.

In some embodiments, the first rigid support strap will be bent at an angle, the first rigid support strap will be affixed to a first side of the first shelf and a second side of the first shelf, the first and second sides of the first shelf being adjacent to each other, and the first rigid support strap will be affixed to a first side of the second shelf and a second side of the second shelf, the first and second sides of the second shelf being adjacent to each other.

The air handling unit may further include a second rigid support strap configured to connect the first shelf to the second shelf.

In some embodiments, the first rigid support strap will be affixed to the first shelf, proximate to a first side of the first shelf, and is affixed to the second shelf, proximate to a first side of the second shelf, the second rigid support strap will be affixed to the first shelf, proximate to a second side of the first shelf, and will be affixed to the second shelf, proximate to a second side of the second shelf, the first side of the first shelf will be formed opposite to the second side of the first shelf, and the first side of the second shelf will be formed opposite to the second side of the second shelf.

In some embodiments, the first rigid support strap will be affixed to the first shelf, proximate to a first side of the first shelf, and is affixed to the second shelf, proximate to a first side of the second shelf, the second rigid support strap will be affixed to the first shelf, proximate to a second side of the first shelf, and is affixed to the second shelf, proximate to a second side of the second shelf, the first side of the first shelf will be formed adjacent to the second side of the first shelf, and the first side of the second shelf will be formed adjacent to the second side of the second shelf.

In some embodiments, the second rigid support strap will be bent at an angle, the second rigid support strap will be affixed to a third side of the first shelf and a fourth side of the first shelf, the third and fourth sides of the first shelf being adjacent to each other, and the second rigid support strap will be affixed to a third side of the second shelf and a fourth side of the second shelf, the third and fourth sides of the second shelf being adjacent to each other.

The air handling unit may further include a cross-brace connected between the first rigid support strap and the second rigid support strap.

BRIEF DESCRIPTION OF THE DRAWINGS

The accompanying figures where like reference numerals refer to identical or functionally similar elements and which together with the detailed description below are incorporated in and form part of the specification, serve to further illustrate an exemplary embodiment and to explain various principles and advantages in accordance with the present invention.

DETAILED DESCRIPTION

The instant disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. Likewise, the use of positional terms such as front, back, side, top, bottom, over, and under are used solely to provide a reference point for one particular orientation, and to enhance the clarity of the disclosure. Their use does not imply that such an orientation is required. In operation, the disclosed air handling units can be used in any desired orientation.

Air Handling Unit Using Hanging Connection Elements

Figure 1B:
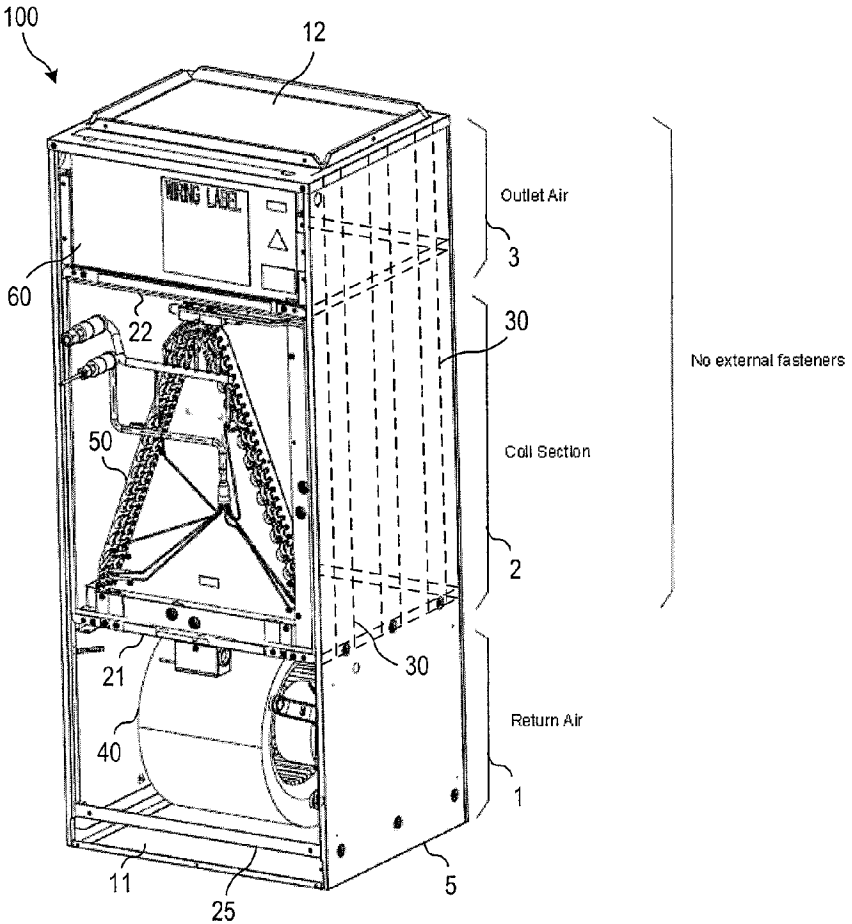
FIGS. 1A and 1B show a perspective view of an air handling unit according to a disclosed embodiment.
Figure 1A:
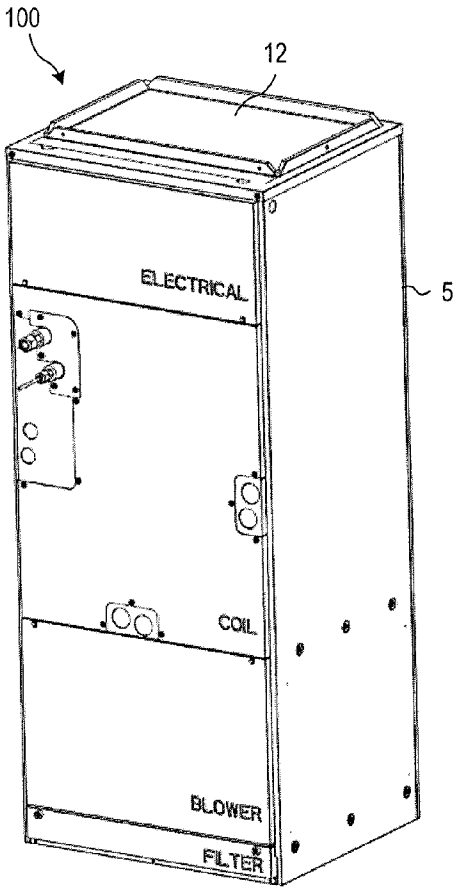

FIGS. 1A and 1B are perspective views of an air handling unit 100 according to a disclosed embodiment. FIG. 1A illustrates the air handling unit 100 with an access panel 10 attached to a front face, while FIG. 1B illustrates the air handling unit 100 with the access panel 10 removed. As shown in FIGS. 1A and 1B, the air handling unit 100 includes a return air section 1, a cooling section 2 formed over the return air section 1, and an outlet air section 3 formed over the cooling section 2. An outer casing 5 (or housing) encloses the return air section 1, the cooling section 2, and the outlet air section 3, which together form an air passage. The outer casing 5 includes an access panel 10, which can be removed to provide access to the elements within the air passageway.

The return air section 1 includes a first brace 25 and an air blower 40; the cooling section 2 includes a coil shelf 21 (a first supporting member) and a heat-exchanging coil 50; and the outlet air section 3 includes a control shelf 22 (a second supporting member) and an electronic control element 60. A plurality of connection elements 30 (third through $N^{th}$ supporting members) hang from the edge of the outer casing 5 at an air outlet opening 12 (a second opening) in the outer casing 5, and are secured to the coil shelf 21 and the control shelf 22.

The first brace 25 is located at the air return side of the air handling unit 100 (the bottom in FIG. 1B), and is connected to the outer casing 5. It defines a return opening 11 (a first opening) in the outer casing 5, and also serves to provide structure to the outer casing 5.

The air blower 40 is supported by the coil shelf 21, and operates to draw air into the return air section 1 from the return opening 11, and blow it through the cooling section 2, into the outlet air section 3 and finally out of the air handling unit 100.

The coil shelf 21 is secured to the outer casing 5 and the supporting members 30, and serves to both provide structure to the outer casing 5 and provide support for the heat-exchanging coil 50 and the control shelf 22. The coil shelf 21 contains an opening (not shown) to allow air to flow from the return air section 1 to the cooling section 2

The heat-exchanging coil 50 is secured to the coil shelf 21 and operates to cool air that passes through the cooling section 2 from the return air section 1 to the outlet air section 3. As noted above, air is blown by the air blower 40 from the return air section 1 into the cooling section 2. This air passes through the heat-exchanging coil 50, and in doing so is reduced in temperature. The airflow caused by the operation of the air blower 40 then moves this cool air from the coil section 2 into the outlet air section 3.

The control shelf 22 is connected to the connection elements 30, but is not directly connected to the outer casing 5. It is suspended between the coil shelf 21 and the outlet air opening 12 by the connection elements 30. The control shelf 22 operates to provide structure to the outer casing 5, and may also serve to support the electronic control element 60. The control shelf 21 contains an opening (not shown) that allows air to pass from the cooling section 2 into the outlet air section 3.

The electronic control element 60 controls the operation of the air handling unit 100. It can be attached to just the control shelf 21, to just the outer casing 5, or to both the control shelf 21 and the outer casing 5. The electronic control element 60 can also contain some insulation located between its electronic circuits and the portion of the air passageway in the outlet air section 3.

The outer casing 5 surrounds all of the other elements of the air handling unit 100, and operates to define the air passageway from the return air opening 11 to the air outlet opening 12. It also serves to support the coil shelf 21 and the connection elements 30.

In addition, a layer of insulation (not shown) is provided between the air passage and the outer casing 5, at least in the portion of the air passage between the coil shelf 21 and the air outlet opening 12. Insulation is only required in the air passage between the coil shelf 21 and the air outlet opening 12, since only this portion of the air passage will contain cool air. In this embodiment, the air blower 40 is upstream from the heat-exchanging coil 50 in the air passage. As a result, the return air section 1 will contain non-cooled air received through the return opening 11, which non-cooled air should be approximately the same temperature as the air outside of the air handling unit 100.

The connection elements 30 in this embodiment hang from the edge of the outer casing 5 at the air outlet opening 12 in the outer casing 5, and extend down to the coil shelf 21 along a side of the outer casing 5. They are secured to the coil shelf 21 and the control shelf 22 inside the outer casing 5. In some embodiments, the connection elements 30 may be secured to the outer casing 5 where they meet the edge of the coil shelf 21, though in other embodiments they can simply hang from the outer casing 105.

In other embodiments, the connection elements 30 need only be connected to the control shelf 22, and not to the coil shelf 21 or the outer casing 5. In this case, the control shelf 22 will be secured in place entirely by the connection elements 30.

Because the connection elements 30 hang from the edge of the outer casing 5, and support the control shelf 22, it is not necessary to pierce the outer casing 5, or any insulation applied to the interior of the outer casing 5 between the coil shelf 21 and the air outlet opening 12 (i.e., the area of the air passage that contains cool air that is insulated). Since the insulation is never pierced, there is no area between the coil shelf 21 and the air outlet opening 12 in which the insulation is less effective. Similarly, since no connection elements stick out into the air passage, there are also no locations within this portion of the air passage in which there is a greater propensity for condensate to form.

This embodiment is only effective when the air handling unit 100 is installed upright, however, since the connection elements 30 hang from the edge of the outer casing 5.

Air Handling Unit Using Internally-Connected Connection Elements

Figure 2:
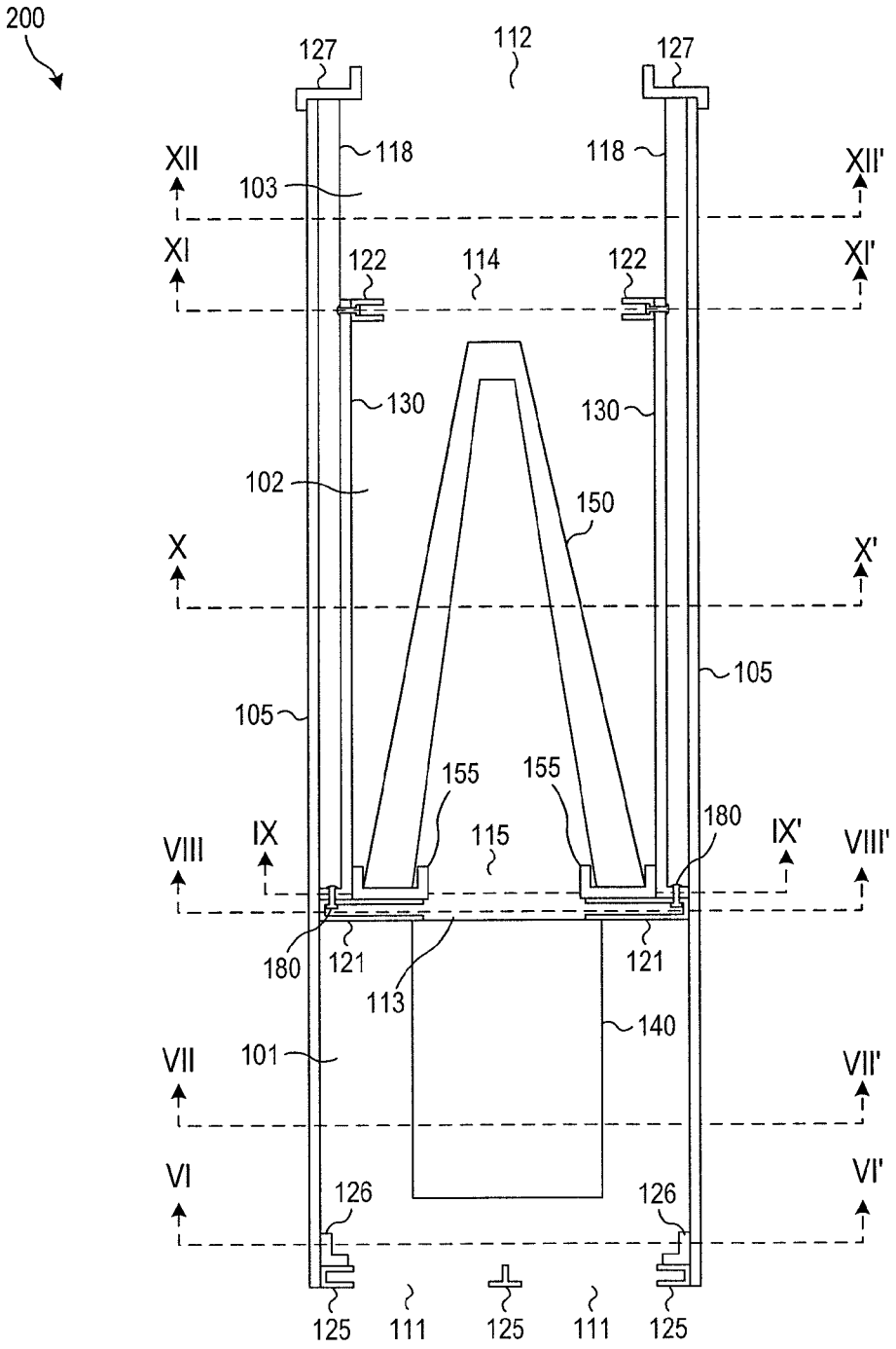
FIG. 2 is a cross-sectional front view of an air handling unit according to a disclosed embodiment.

FIG. 2 is a cross-sectional front view of an air handling unit 200 according to another disclosed embodiment. In this embodiment, the air handling unit 200 can be arranged in any orientation, not just upright. It can be turned upside down or laid on its side, and it will still function properly. In particular, FIG. 2 is the cross section along the line II-II' in FIGS. 6-12.

As shown in FIG. 2, the air handling unit 200 has a return air section 101, a cooling section 102 formed adjacent to the return air section 101, and an outlet air section 103 formed adjacent to the cooling section 102, all enclosed by an outer casing 105 (or housing). The air handling unit 200 includes: the outer casing 105, a return air opening 111 (a first opening), an outlet air opening 112 (a second opening), casing insulation 118, a coil shelf 121 (a first supporting member), a control shelf 122 (a second supporting member), a first brace 125, a second brace 126, a third brace 127, a plurality of flat connection elements 130 (third through $N^{th}$ supporting members), an air blower 140, a heat-exchanging coil 150, and a vertical drain pan 155.

The outer casing 105 encloses the return air section 101, the cooling section 102, and the outlet air section 103 to define an air passageway for the passage of air from the air return opening 111 to the outlet air opening 112. The outer casing 105 contains an access opening (not shown in FIG. 2) to provide the user with access to its internal components.

The outer casing 105 is connected to and provides support to the first brace 125, the second brace 126, and the coil shelf 121. In the disclosed embodiment, the outer casing 105 is made of metal, such as steel. However, in alternate embodiments, the outer casing 105 could also be made of aluminum, plastic, or any other suitable material.

The return air opening 111 is formed in the outer casing 105 at an end of the return air section 101 opposite the cooling section 102. It provides a place for non-cooled air to be brought into the air passageway to be cooled.

The air outlet opening 112 is formed in the outer casing 105 at an end of the air outlet section 103 opposite the cooling section 102. It provides a location for cooled air to be output from the air passageway.

The casing insulation 118 is formed next to the outer casing 105 between the coil shelf 121 and the outlet air opening 112. It operates to insulate the air passageway between the coil shelf 121 and the outlet air opening 112 from the area outside the outer casing 105. Nothing pierces or perforates the casing insulation 118 between the coil shelf 121 and the outlet air opening 112.

In the disclosed embodiment, the casing insulation 118 is a flexible, closed-cell elastomeric compound, such as Polytech® Low-FS Closed Cell Foam or Aerocell® EPDM Elastomeric Sheet Insulation. However, in alternate embodiments different insulating materials, such as fiberglass, mineral wood, polyester, melamine, phenolic, polyethylene, or cotton, could be used.

The coil shelf 121 is formed where the return air section 101 and the cooling section 102 meet. It abuts the walls of the outer casing 105, and has a coil shelf opening 113 in its middle, to allow air to pass from the return air section 101 to the cooling section 102.

The coil shelf 121 is attached to both the outer casing 105 and two each of the plurality of flat connection elements 130 by one or more affixing elements 180, such as screws, bolts, or any suitable mechanism for securely attaching the flat connection elements 130 to the coil shelf 121. In this way, the coil shelf 121 (and the outer casing 105) support the plurality of flat connection elements 130.

The control shelf 122 is formed where the cooling section 102 and the air outlet section 103 meet. It is attached to each of the plurality of flat connection elements 130 by one or more affixing elements 180, such as screws, bolts, or any suitable mechanism for securely attaching the flat connection elements 130 to the coil shelf 121. The control shelf 122 has a control shelf opening 114 in its middle, to allow air to pass from the cooling section 102 to the outlet air section 103.

The control shelf 122 is formed such that the casing insulation 118 is located between the control shelf 122 and the outer casing 105. The control shelf 122 is not directly connected to the outer casing 105.

The first brace 125 and the second brace 126 are formed proximate to the return air opening 111, and serve to support the return air opening 111 and the portion of the outer casing 105 next to the return air opening 111.

The third brace 127 is formed proximate to the outlet air opening 112 and serves to support the output air opening 112 and the portion of the outer casing 105 next to the output air opening 112.

Although three braces 125, 126, 127 are shown in this embodiment more or fewer braces could be used in alternate embodiments. Some embodiments could eliminate the braces altogether.

The plurality of flat connection elements 130 extend between the coil shelf 121 and the control shelf 122, and are connected to both the coil shelf 121 and the control shelf 122 by connection elements 180, such as screws, bolts, or any suitable mechanism for securely attaching the flat connection elements 130 to the coil shelf 121 and the control shelf 122. In the embodiment disclosed in FIG. 2, the plurality of flat connection elements 130 are each connected to the top surface of the coil shelf 121, and are connected to a side surface of the control shelf 122. However, this is by way of example only. In alternate embodiments, the plurality of flat connection elements 130 could be connected to different portions of the coil shelf 121 and the control shelf 122. Furthermore, in some alternate embodiments the portion of the flat connection elements 130 proximate to the coil shelf 121 could be further connected to the outer casing 105.

The portion of the flat connection elements 130 proximate to the control shelf 122 are not directly connected to the outer casing 105. In addition, the casing insulation 118 is formed between the flat connection elements 130 and the outer casing 105 from the coil shelf 121 to the control shelf 122.

The air blower 140 operates to draw air into the return air section 101 from the return opening 111, and blow it into the cooling section 102, then into the outlet air section 103, and finally out of the air handling unit 200 through the outlet opening 112.

The heat-exchanging coil 150 is secured to the coil shelf 121 and operates to cool air that passes through the cooling section 102 from the return air section 101 to the outlet air section 103. Air is blown by the air blower 140 from the return air section 101 into the cooling section 102. This air passes through the heat-exchanging coil 150, and in doing so is reduced in temperature. The airflow caused by the operation of the air blower 140 then moves this cool air from the coil section two into the outlet air section 103.

The vertical drain pan 155 is placed below the heat-exchanging coil 150 and operates to collect condensation that forms on and around the heat-exchanging coil 150. The vertical drain pan 155 has at least one outlet to remove the condensation from the vertical drain pan 155. The vertical drain pan 155 has a vertical drain pan opening 115 in its middle, to allow air to pass from the return air section 101 to the cooling section 102. In alternate embodiments in which the air handling unit 200 is placed on its side, an additional vertical drain pan (not shown) should be placed beneath the heat-exchanging coil 150. Because it would not be placed within the center of the air passage, such a vertical drain pan would not need an opening in its middle.

Figure 3:
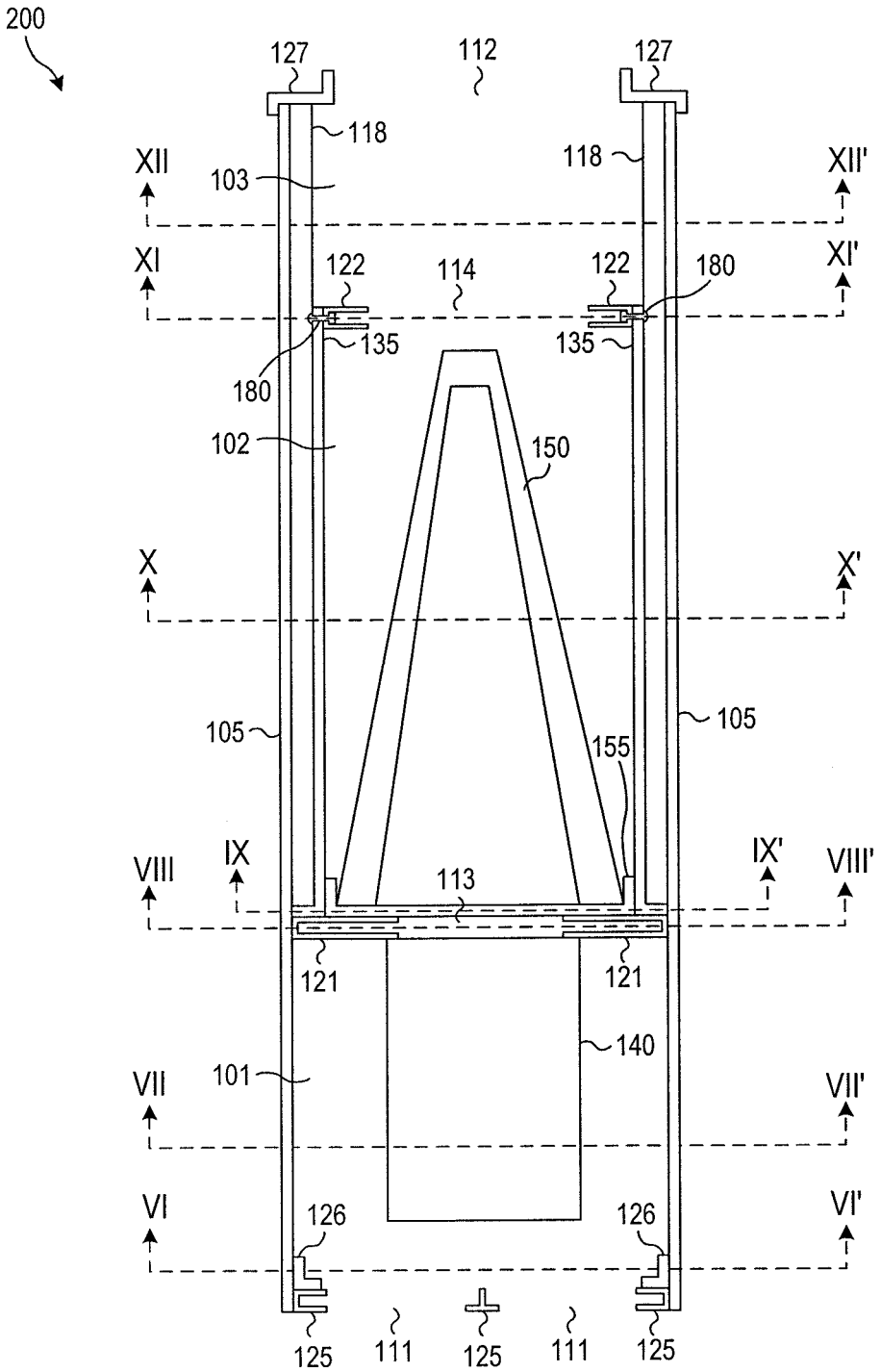
FIG. 3 is another cross-sectional front view of the air handling unit of FIG. 2 according to a disclosed embodiment.

FIG. 3 is another cross-sectional front view of the air handling unit 200 of FIG. 2 according to a disclosed embodiment. In particular, FIG. 3 is the cross section along the line III-III' in FIGS. 6-12.

As shown in FIG. 3, the air handling unit 200 includes: the outer casing 105, the air return opening 111 (a first opening), the outlet air opening 112 (a second opening), the casing insulation 118, the coil shelf 121 (a first supporting member), the control shelf 122 (a second supporting member), the first brace 125, the second brace 126, the third brace 127, the plurality of bent connection elements 135 (third through $N^{th}$ supporting members), the air blower 140, the heat-exchanging coil 150, and the vertical drain pan 155.

The outer casing 105, the air return opening 111, the outlet air opening 112, the casing insulation 118, the coil shelf 121, the control shelf 122, the first brace 125, the second brace 126, the third brace 127, the air blower 140, the heat-exchanging coil 150, and the vertical drain pan 155 all operate as described above with respect to FIG. 2. Their description will not be repeated here.

The plurality of bent connection elements 135 extend between the coil shelf 121 and the control shelf 122, and are connected to both the coil shelf 121 and the control shelf 122 by connection elements 180, such as screws, bolts, or any suitable mechanism for securely attaching the bent connection elements 135 to the coil shelf 121 and the control shelf 122. In the embodiment disclosed in FIG. 3, the plurality of bent connection elements 135 are each connected to the top surface of the coil shelf 121, and are connected to a side surface of the control shelf 122. However, this is by way of example only. In alternate embodiments, the plurality of bent connection elements 135 could be connected to different portions of the coil shelf 121 and the control shelf 122. Furthermore, in some alternate embodiments the portion of the bent connection elements 135 proximate to the coil shelf 121 could be further connected to the outer casing 105.

The portions of the bent connection elements 135 proximate to the control shelf 122 are not directly connected to the outer casing 105. In addition, the casing insulation 118 is formed between the bent connection elements 135 and the outer casing 105 from the coil shelf 121 to the control shelf 122.

Figure 4:
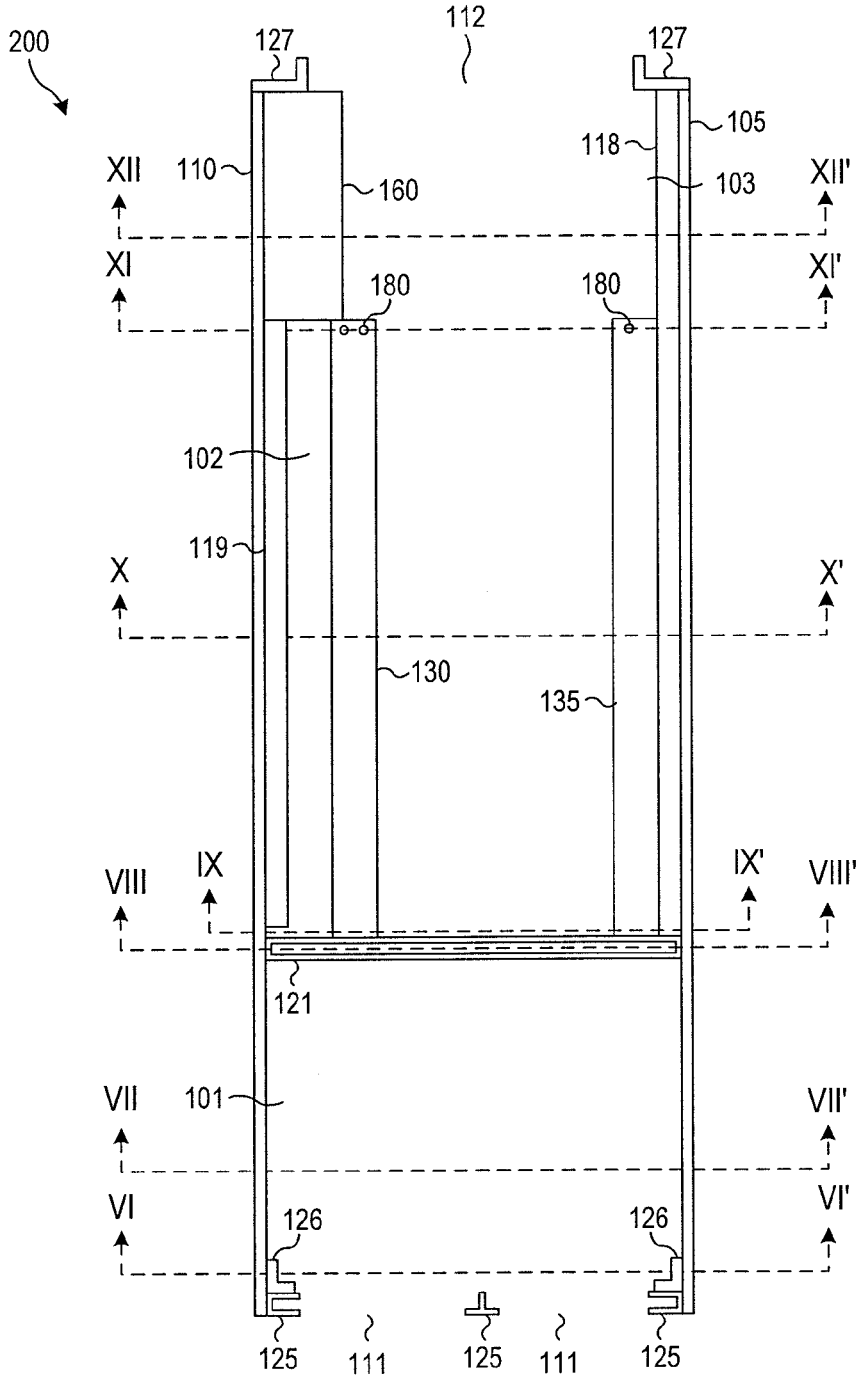
FIG. 4 is a cross-sectional side view of the air handling unit of FIG. 2 according to a disclosed embodiment.

FIG. 4 is a cross-sectional side view of the air handling unit 200 of FIG. 2 according to a disclosed embodiment. In particular, FIG. 4 is the cross section along the line IV-IV' in FIGS. 6-12.

As shown in FIG. 4, the air handling unit 200 includes: the outer casing 105, an access panel 110, the air return opening 111 (a first opening), the outlet air opening 112 (a second opening), the casing insulation 118, access panel insulation 119, the coil shelf 121 (a first supporting member), the first brace 125, the second brace 126, the third brace 127, the plurality of flat connection elements 130 (third through $N^{th}$ supporting members), the plurality of bent connection elements 135 (third through $N^{th}$ supporting members), the air blower 140, the heat-exchanging coil 150, and an electronic control element 160.

The outer casing 105, the air return opening 111, the outlet air opening 112, the casing insulation 118, the coil shelf 121, the control shelf 122, the first brace 125, the second brace 126, the third brace 127, the flat and bent connection elements 130, 135, the air blower 140, and the heat-exchanging coil 150 all operate as described above with respect to FIGS. 2 and 3. Their description will not be repeated here.

The access panel 110 is configured to cover an access opening formed on a front of the outer casing 105, and to seal off of the air passageway, except for the return air opening 111 and the outlet air opening 112. The access opening is provided so that an operator can access the elements of the air handling unit 200 in the air passageway. In this disclosed embodiment, the access panel is made of the same material as the outer casing 105. However, in alternate embodiments, a different material can be used.

The access panel insulation 119 is formed next to the access panel 110 such that, together with the casing insulation 118, it will insulate the air passageway between the first shelf 121 and the air outlet opening 112 when the access panel 110 is attached to the housing 105. Nothing pierces or perforates the access panel insulation 119 where it is formed.

The electronic control element 160 serves to control the operation of the air blower 140 and the heat-exchanging coil 150. In the disclosed embodiment, the electronic control element 160 is insulated such that it insulates the air passageway from the remainder of the electronic control element 160. As a result, the access panel insulation 119 only needs to extend between the coil shelf 121 and the electronic control element 160. The insulation in the electronic control element 160 serves to insulate the portion of the air passageway adjacent to it. In alternate embodiments, however, the electronic control element 160 might not be insulated, in which case the access panel insulation 119 should extend from the coil shelf 121 all the way to the output air opening 112

In the disclosed embodiment, the electronic control element 160 is affixed to the control shelf 122, but not the outer casing 105. However, in alternate embodiments, the electronic control element 160 could be a fixed to the outer casing 105, or both the control shelf 122 and the outer casing 105. Because the electronic control element 160 is insulated, there is no need to have the casing insulation 118 formed adjacent to it. As result, affixing the electronic control element 160 to the outer casing 105 would not pierce the casing insulation 118.

Figure 5:
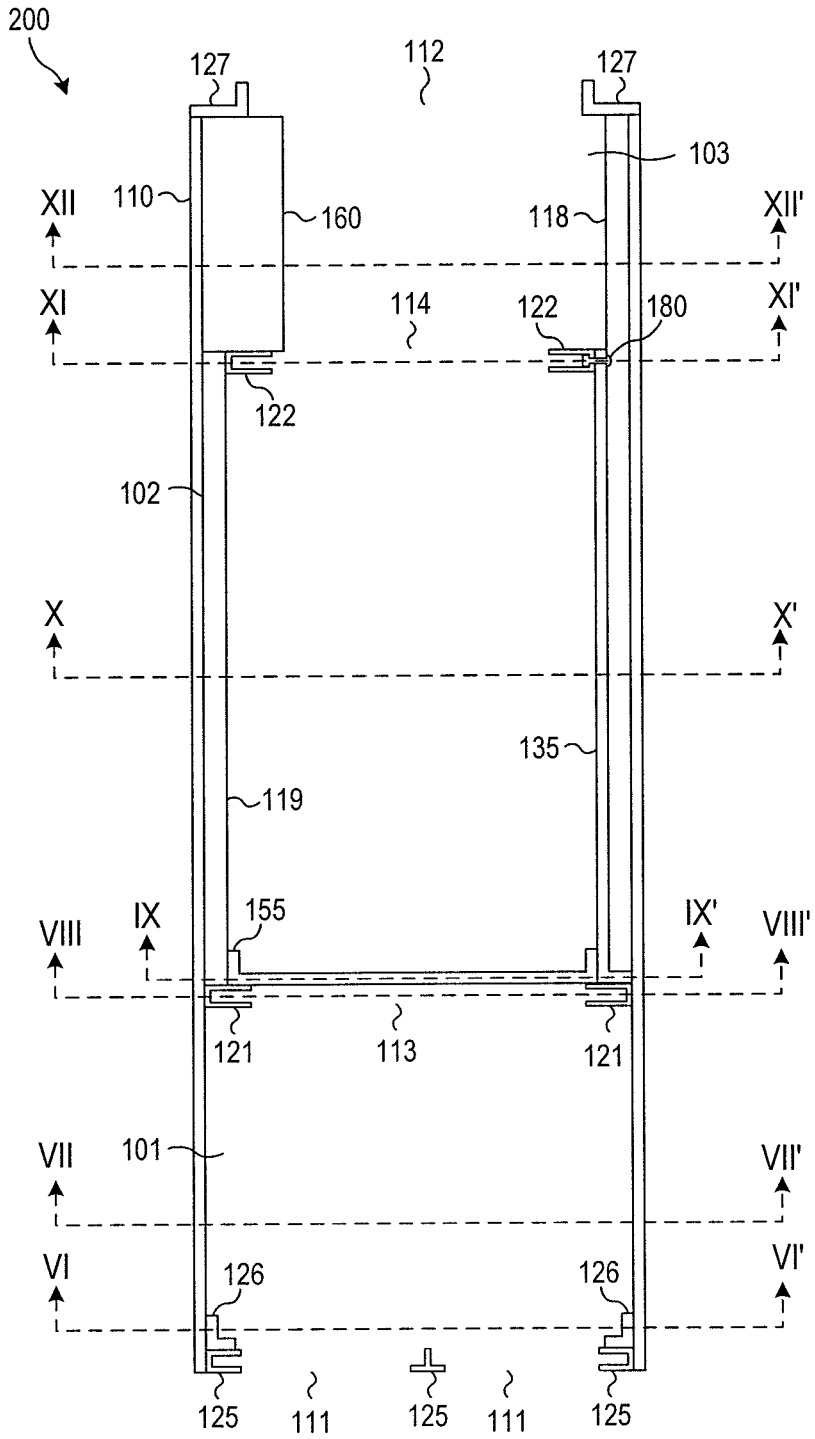
FIG. 5 is another cross-sectional side view of the air handling unit of FIG. 2 according to a disclosed embodiment.

FIG. 5 is another cross-sectional side view of the air handling unit of FIG. 2 according to a disclosed embodiment. In particular, FIG. 5 is the cross section along the line V-V' in FIGS. 6-12.

As shown in FIG. 5, the air handling unit 200 includes: the outer casing 105, the access panel 110, the air return opening 111 (a first opening), the outlet air opening 112 (a second opening), the casing insulation 118, the access panel insulation 119, the coil shelf 121 (a first supporting member), the control shelf 122 (a second supporting member), the first brace 125, the second brace 126, the third brace 127, the plurality of bent connection elements 135 (third through $N^{th}$ supporting members), the air blower 140, the heat-exchanging coil 150, the vertical drain pan 155, and the electronic control element 160.

The outer casing 105, the access panel 110, the air return opening 111, the outlet air opening 112, the casing insulation 118, the access panel insulation 119, the coil shelf 121, the control shelf 122, the first brace 125, the second brace 126, the third brace 127, the second supporting members 135, the air blower 140, the heat-exchanging coil 150, the vertical drain pan 155, and the electronic control element 160 all operate as described above with respect to FIGS. 2-4. Their description will not be repeated here.

FIG. 5 shows that the second supporting members 135 extend along the back of the air handling unit 200 (and thus the back of the coil shelf 121 and the back of the control shelf 122). By extending along both the side and the back of both the coil shelf 121 and the control shelf 122, the second supporting members 135 provide greater stability to the entire structure.

Figure 6:
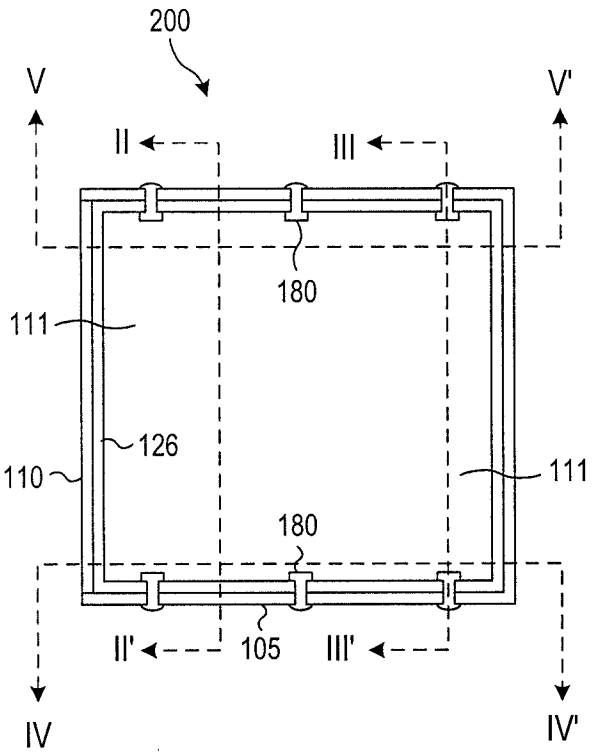
FIG. 6 is a cross-sectional top view of the air handling unit of FIG. 2 according to a disclosed embodiment.

FIG. 6 is a cross-sectional top view of the air handling unit of FIG. 2 according to a disclosed embodiment. In particular, FIG. 6 is the cross section along the line VI-VI' in FIGS. 2-5.

As shown in FIG. 6, the air handling unit 200 includes: the outer casing 105, the access panel 110, the return air opening 111 (a first opening), the second brace 126. These elements all operate as described above with respect to FIGS. 2-5. Their description will not be repeated here.

FIG. 6 shows that the second brace 126 helps to form the return air opening 111 at one end of the air handling unit 200. Since the air drawn in through the return air opening 111 is non-cooled air, there is no need for any insulation adjacent to the outer casing 105 or the access panel 110. As result, the second brace 126 can be affixed to the outer casing 105 by a plurality of affixing elements 180.

Figure 7:
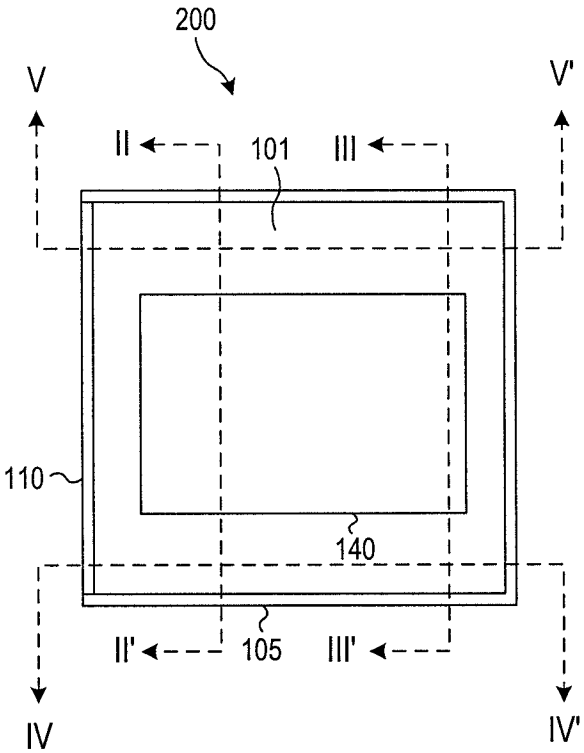
FIG. 7 is another cross-sectional top view of the air handling unit of FIG. 2 according to a disclosed embodiment.

FIG. 7 is another cross-sectional top view of the air handling unit of FIG. 2 according to a disclosed embodiment. In particular, FIG. 7 is the cross section along the line VII-VII' in FIGS. 2-5.

As shown in FIG. 7, the air handling unit 200 includes: the outer casing 105, the access panel 110, and the air blower 140. These elements all operate as described above with respect to FIGS. 2-5. Their description will not be repeated here.

FIG. 7 shows that in the return air section 101, in which the air blower 140 is placed, there is no need for any insulation adjacent to either the outer casing 105 or the access panel 110. This is because the air passing through the return air section 101 is non-cooled air.

Figure 8:
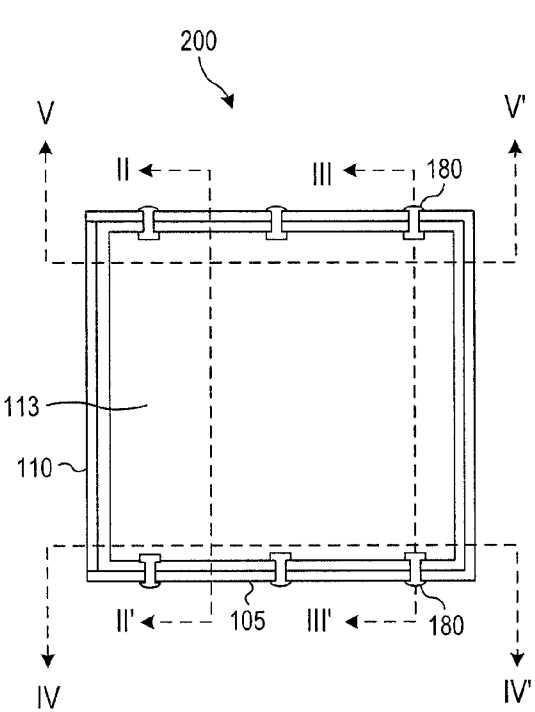
FIG. 8 is yet another cross-sectional top view of the air handling unit of FIG. 2 according to a disclosed embodiment.

FIG. 8 is yet another cross-sectional top view of the air handling unit of FIG. 2 according to a disclosed embodiment. In particular, FIG. 8 is the cross section along the line VIII-VIII' in FIGS. 2-5.

As shown in FIG. 8, the air handling unit 200 includes: the outer casing 105, the access panel 110, and the coil shelf. These elements all operate as described above with respect to FIGS. 2-5. Their description will not be repeated here.

FIG. 8 shows that there is no insulation needed adjacent to the coil shelf 121. This is because air passing through the coil shelf opening 113 is still non-cooled air, which does not need to be insulated from air outside of the outer casing 105. As a result, the coil shelf 121 can be affixed to the outer casing 105 using the plurality of affixing elements 180, without piercing or puncturing any insulation, 118, 119.

Figure 9:
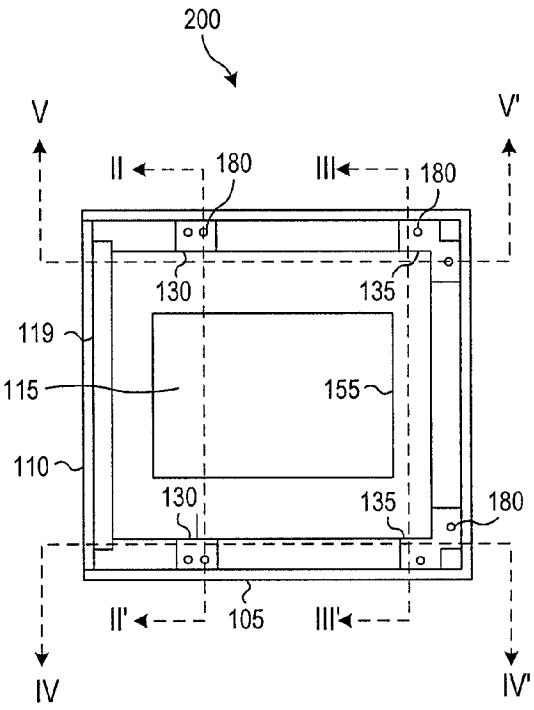
FIG. 9 is still another cross-sectional top view of the air handling unit of FIG. 2 according to a disclosed embodiment.

FIG. 9 is still another cross-sectional top view of the air handling unit of FIG. 2 according to a disclosed embodiment. In particular, FIG. 9 is the cross section along the line IX-IX' in FIGS. 2-5.

As shown in FIG. 9, the air handling unit 200 includes: the outer casing 105, the access panel 110, the plurality of flat connection elements 130 (third through $N^{th}$ supporting members), the plurality of bent connection elements 135 (third through $N^{th}$ supporting members), and the vertical drain pan 155. These elements all operate as described above with respect to FIGS. 2-5. Their description will not be repeated here.

FIG. 9 shows that in addition to extending from the coil shelf 121 to the control shelf 122, the flat and bent connection elements 130, 135 are bent at the bottom so that they can extend for some distance flat against the top surface of the coil shelf 121. This allows them to be securely affixed to the coil shelf 121 by affixing elements 180, while leaving some room for the casing insulation 118 to be placed in between the remainder of the flat and bent connection elements 130, 135 and the outer casing 105.

Since, the air passing through the vertical drain pan opening 115 is still non-cooled air, there is no need for either casing insulation 118 or access panel insulation 119. However, in this embodiment, the access panel insulation 119 extends such that it is adjacent to the vertical drain pan 155 in order to provide better coverage of the insulation along the inside of the outer casing 105.

Figure 10:
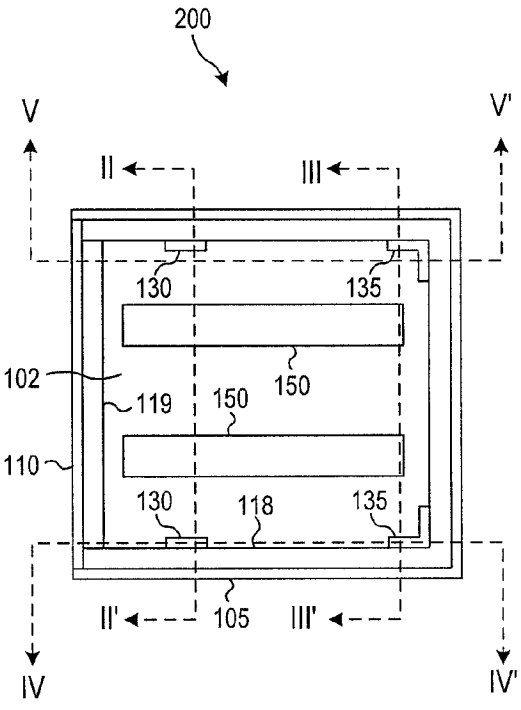
FIG. 10 is yet another cross-sectional top view of the air handling unit of FIG. 2 according to a disclosed embodiment.

FIG. 10 is yet another cross-sectional top view of the air handling unit of FIG. 2 according to a disclosed embodiment. In particular, FIG. 10 is the cross section along the line X-X' in FIGS. 2-5.

As shown in FIG. 10, the air handling unit 200 includes: the outer casing 105, the access panel 110, the casing insulation 118, the access panel insulation 119, the plurality of flat connection elements 130 (third through $N^{th}$ supporting members), the plurality of bent connection elements 135 (third through $N^{th}$ supporting members), and the heat-exchanging coil 150. These elements all operate as described above with respect to FIGS. 2-5. Their description will not be repeated here.

FIG. 10 shows that the portion of the cooling section 102 above the coil shelf 121, and above the portions of the flat and bent connection elements 130, 135 that extend along the top surface of the coil shelf 121, must be insulated. This is because in this portion of the air passageway, the heat-exchanging coil 150 is cooling the air received from the return air section 101. As a result the air in this portion of the air passageway will be cooler than the air outside of the outer casing 105.

In addition, FIG. 10 illustrates how the bent connection elements 135 are bent such that they run parallel to both the side and the back of the outer casing 105.

Figure 11:
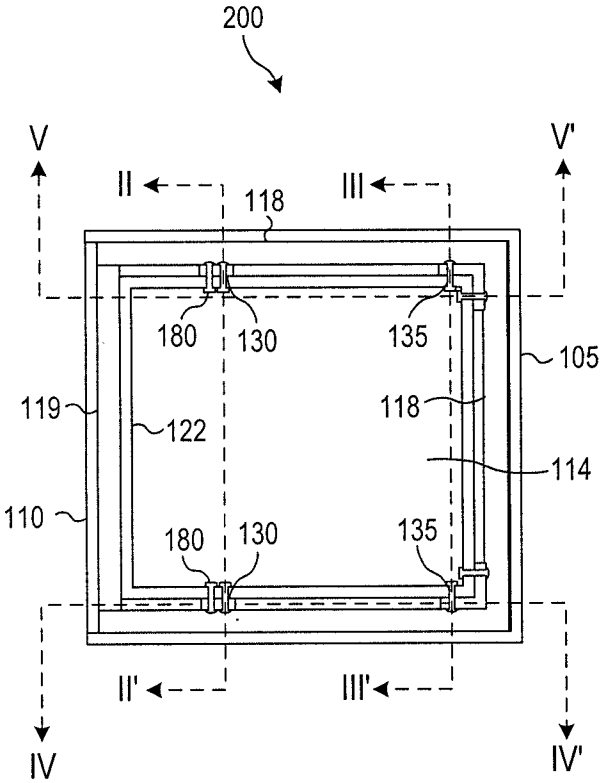
FIG. 11 is still another cross-sectional top view of the air handling unit of FIG. 2 according to a disclosed embodiment.

FIG. 11 is still another cross-sectional top view of the air handling unit of FIG. 2 according to a disclosed embodiment. In particular, FIG. 11 is the cross-section along the line XI-XI' in FIGS. 2-5.

As shown in FIG. 11, the air handling unit 200 includes: the outer casing 105, the access panel 110, the casing insulation 118, the access panel insulation 119, the plurality of flat connection elements 130 (third through $N^{th}$ supporting members), the plurality of bent connection elements 135 (third through $N^{th}$ supporting members), and the control shelf 122. These elements all operate as described above with respect to FIGS. 2-5. Their description will not be repeated here.

FIG. 11 shows that the flat and bent connection elements 130, 135 are placed such that the casing insulation 118 is located between the flat and bent connection elements 130, 135 and the outer housing 105. In addition, FIG. 11 shows that the control shelf 122 is further connected to the flat and bent connection elements 130, 135 inside of the casing insulation 118. As a result, there is no need to pierce either the casing insulation 118 or the outer housing 105 in order to support the control shelf 122. This allows the casing insulation 118 to function properly along its entire extent, and provides no places where condensation is more likely to form inside the air passageway.

Figure 12:
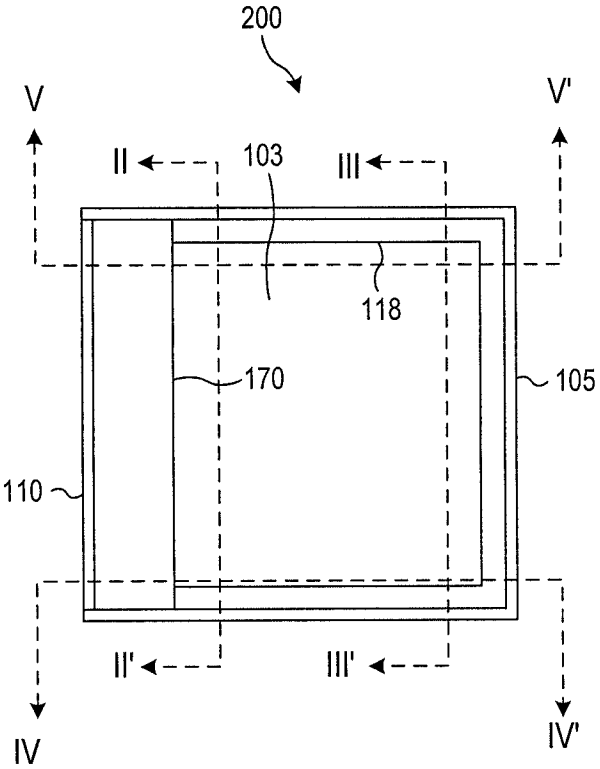
FIG. 12 is yet another cross-sectional top view of the air handling unit of FIG. 2 according to a disclosed embodiment.

FIG. 12 is yet another cross-sectional top view of the air handling unit of FIG. 2 according to a disclosed embodiment. In particular, FIG. 12 is the cross section along the line XII-XII' in FIGS. 2-5.

As shown in FIG. 12, the air handling unit 200 includes: the outer casing 105, the access panel 110, the casing insulation 118, and the electronic control element 160. These elements all operate as described above with respect to FIGS. 2-5. Their description will not be repeated here.

In this embodiment, the electronic control element 160 is insulated such that, together with the casing insulation 118, it insulates the outlet air section 103 of the air passageway. In alternate embodiments, however, the electronic control element 160 need not be insulated. In such embodiments, the casing insulation 118 and the access panel insulation 119 should be extended such that they surround the electronic control element 160, in order to adequately insulate the outlet air section 103 of the air passageway.

Figure 14:
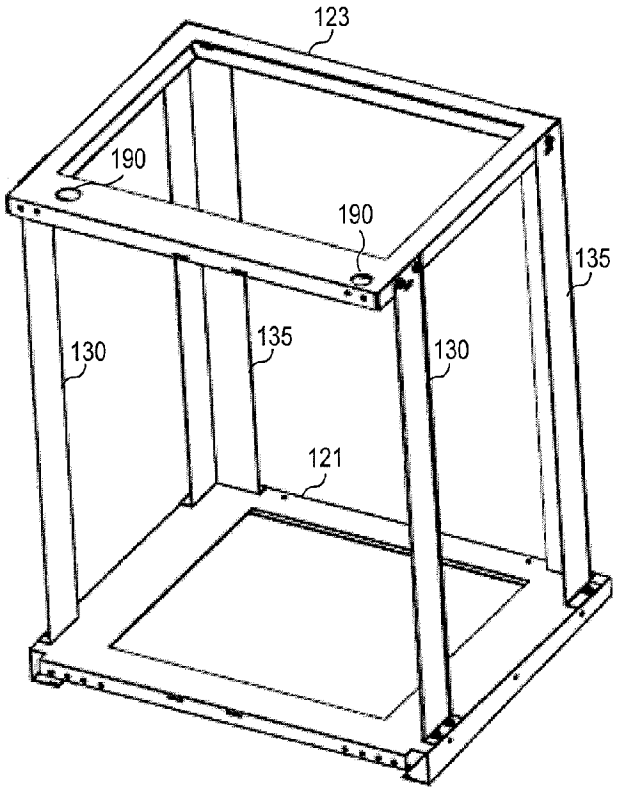
FIG. 14 is a perspective view of the air handling unit of FIG. 13, showing the connection elements attached to the coil shelf and the control shelf according to a disclosed embodiment.
Figure 13:
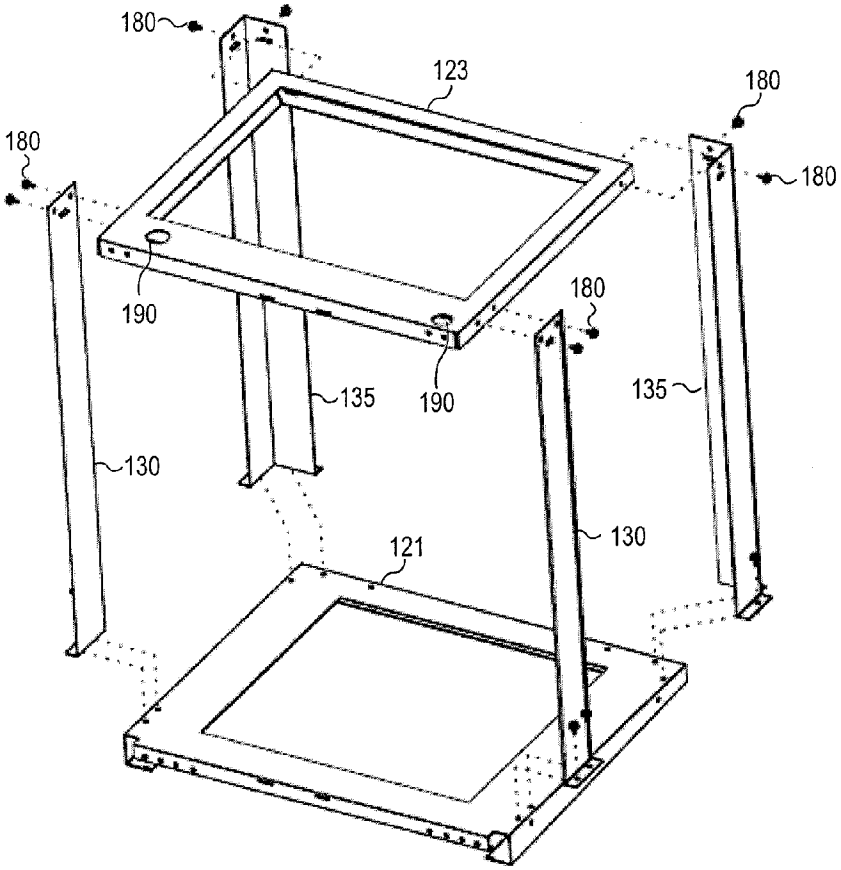
FIG. 13 is a perspective view of an air handling unit having four connection elements, showing how the connection elements are attached to the coil shelf and the control shelf according to a disclosed embodiment.

FIG. 13 is a perspective view of an air handling unit having four connection elements 130, 135, showing how the connection elements 130, 135 are attached to the coil shelf 121 and the control shelf 122 according to a disclosed embodiment; and FIG. 14 is a perspective view of the air handling unit of FIG. 13, showing the connection elements 130, 135 attached to the coil shelf 121 and the control shelf 122 according to a disclosed embodiment.

As shown in FIGS. 13 and 14, the flat connection elements 130 have bent portions at the bottom that are connected to a top surface of the coil shelf 121, while the flat connection elements 130 are connected at the top to a side surface of the control shelf 122. Similarly, the bent connection elements 135 have bent portions at the bottom that are connected to a top surface of the coil shelf 121, while the bent connection elements are connected at the top to both side surfaces and back surfaces of the control shelf 122. These connections are made with affixing elements 180, which may be screws, bolts or any appropriate mechanism for affixing the flat and bent connection elements 130, 135 to the coil shelf 121 and the control shelf 122.

In addition, FIGS. 13 and 14 also show that the control shelf 122 includes a plurality of access holes 190. These access holes 190 allow control lines to extend from the electronic control element 160 to the air blower 140 and the heat-exchanging coil 150 below.

Figure 15:
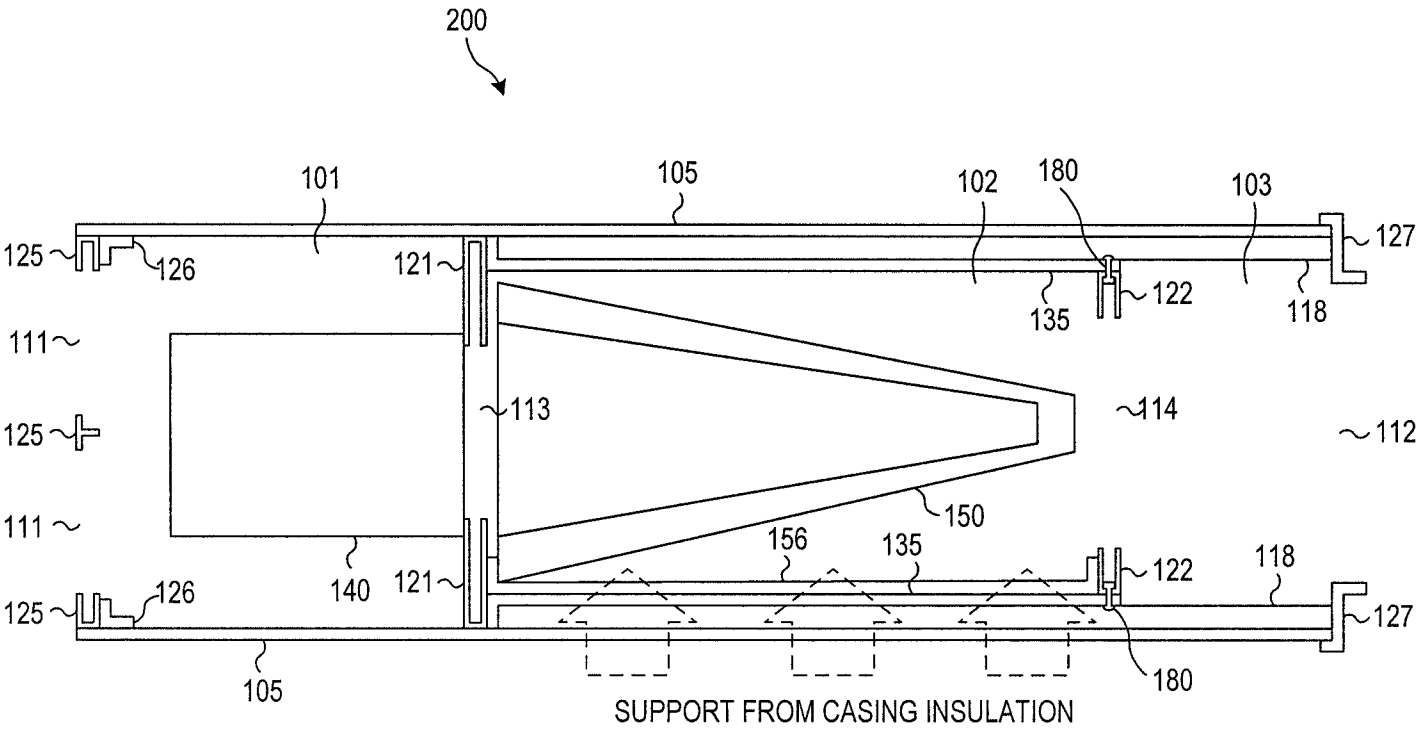
FIG. 15 is a cross-sectional front view of an air handling unit in a sideways position according to another disclosed embodiment.

FIG. 15 is a cross-sectional front view of an air handling unit in a sideways position according to another disclosed embodiment. FIG. 15 is similar to FIG. 3, except that FIG. 3 shows the air handling unit 200 positioned upright, while FIG. 15 shows the air handling unit 200 positioned on its side.

As shown in FIG. 15, the air handling unit 200 includes: the outer casing 105, the air return opening 111 (a first opening), the outlet air opening 112 (a second opening), the casing insulation 118, the coil shelf 121 (a first supporting member), the control shelf 122 (a second supporting member), the first brace 125, the second brace 126, the third brace 127, the plurality of bent connection elements 135 (third through $N^{th}$ supporting members), the air blower 140, the heat-exchanging coil 150, and a horizontal drain pan 156. All of these items, except for the horizontal drain pan 156, operate as described above with respect to FIGS. 2-5. Their description will not be repeated here.

The horizontal drain pan 156 is placed under the heat-exchanging coil 150, and operates to collect condensation that forms on and around the heat-exchanging coil 150. The horizontal drain pan 156 has at least one outlet to remove the condensation from the horizontal drain pan 156. Unlike the vertical drain pan 155, which has a vertical drain pan opening 115 in its middle, to allow air to pass from the return air section 101 to the cooling section 102, the horizontal drain pan 156 requires no such opening in its middle. Air passes above the horizontal drain pan 156 as it passes through the air passageway.

FIG. 15 illustrates how the framework of the coil shelf 121, the control shelf 122, and the connection elements 130, 135 are supported when the air handling unit 200 is positioned on its side. Because the heat-exchanging coil 150 is heavy, and is affixed to the coil shelf 121, the entire framework of the coil shelf 121, the control shelf 122, and the connection elements 130, 135 will press down toward one side (now bottom) of the outer casing 105. Since the control shelf 122 is not affixed to the other side (now top) of the outer casing 105, the framework of the coil shelf 121, the control shelf 122, and the connection elements 130, 135 the control shelf 122 would tend to dip toward the outer casing 105 in the area closest to the control shelf 122, absent some additional support. Such motion of this framework would cause stress on the coil shelf 121 and outer casing 105 where the two are affixed by affixing elements 180.

However, the flexible, closed-cell elastomeric compound used as the casing insulation 118 in the disclosed embodiment is firm enough that when the weight of the coil shelf 121, the control shelf 122, the connection elements 130, 135, and the heat-exchanging coil 150 are spread out along where the connection elements 130, 135 contact the casing insulation 118, the casing insulation 118 will provide support to the framework of the coil shelf 121, the control shelf 122, and the connection elements 130, 135. The support is sufficient that no undue strain will be placed on the outer casing 105, the coil shelf 121, or the affixing elements 180 that affix the two together.

Placement of the Connection Elements

FIGS. 2-15 show one possible arrangement of connection elements 130, 135 for use in an air handling unit. However, this is by way of example only. Numerous other arrangements are possible, as shown by FIGS. 16-23, which roughly correspond to FIG. 10 in the previously disclosed embodiment. In particular, each of FIGS. 16-23 corresponds to a cross-section along the place designated by the line X-X' in FIGS. 2-5 in an alternate embodiment.

As shown in FIGS. 16-23, each of these embodiments includes an outer casing 105, an access panel 110, casing insulation 118, access insulation 119, and a heat-exchanging coil 150. These elements are described above with respect to the embodiment of FIGS. 2-12. Their description will not be repeated here.

Figure 16:
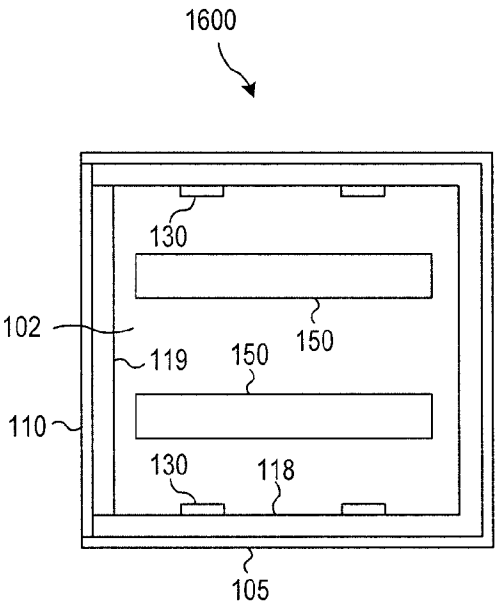
FIG. 16 is a cross-sectional top view of an air handling unit according to an disclosed embodiment.

FIG. 16 is a cross-sectional top view of an air handling unit 1600 according to a disclosed embodiment. As shown in FIG. 16, in this embodiment, four flat connection elements 130 are provided, two each on opposite sides of the air handling unit 1600.

Figure 17:
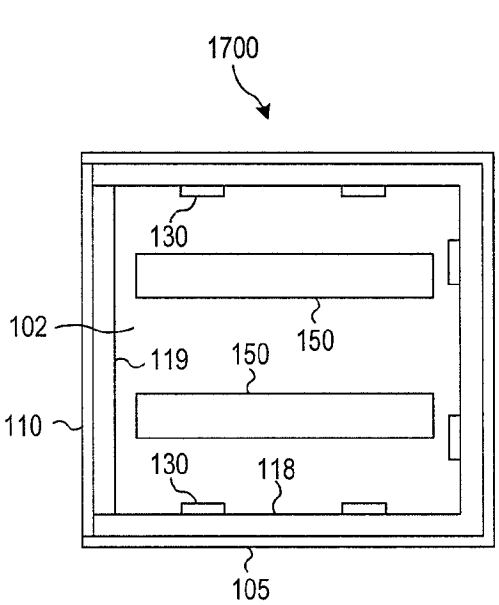
FIG. 17 is a cross-sectional top view of an air handling unit according to another disclosed embodiment.

FIG. 17 is a cross-sectional top view of an air handling unit 1700 according to another disclosed embodiment. As shown in FIG. 17, in this embodiment six flat connection elements 130 are provided, two each on opposite sides of the air handling unit 1700, and two along the back of the air handling unit 1700.

Figure 18:
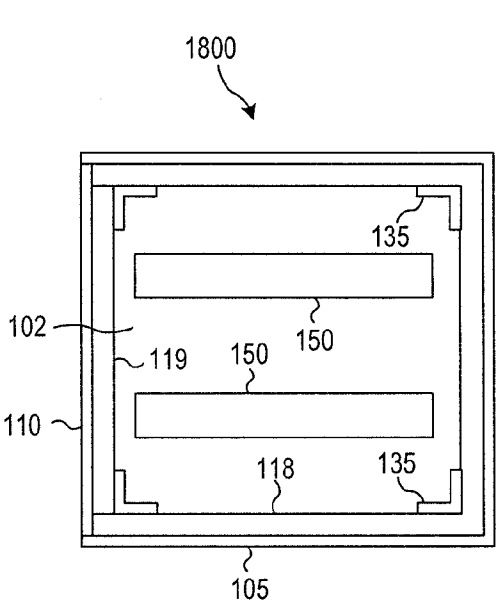
FIG. 18 is a cross-sectional top view of an air handling unit according to yet another disclosed embodiment.

FIG. 18 is a cross-sectional top view of an air handling unit 1800 according to yet another disclosed embodiment. As shown in FIG. 18, in this embodiment four bent connection elements 135 are provided, one at each corner of the air handling unit 1800.

Figure 19:
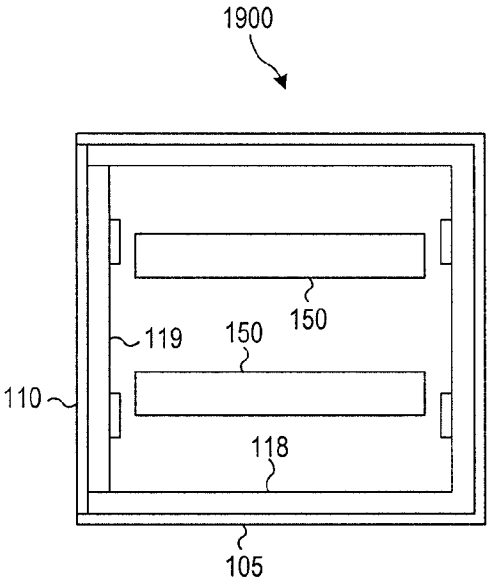
FIG. 19 is a cross-sectional top view of an air handling unit according to still another disclosed embodiment.

FIG. 19 is a cross-sectional top view of an air handling unit 1900 according to still another disclosed embodiment. As shown in FIG. 19, two flat connection elements 130 are provided, two at the front of the air handling unit 1900, and two at the back of the air handling unit 1900.

Although many embodiments may avoid using connection elements 130, 135 in the front of the air handling unit so as to avoid interfering with the access panel 110, there is no structural reason why they can't be placed there. All that would be necessary to accommodate this placement would be to arrange the elements inside the outer casing 105 such that they could be properly serviced despite the presence of the connection elements 130, 135.

Figure 20:
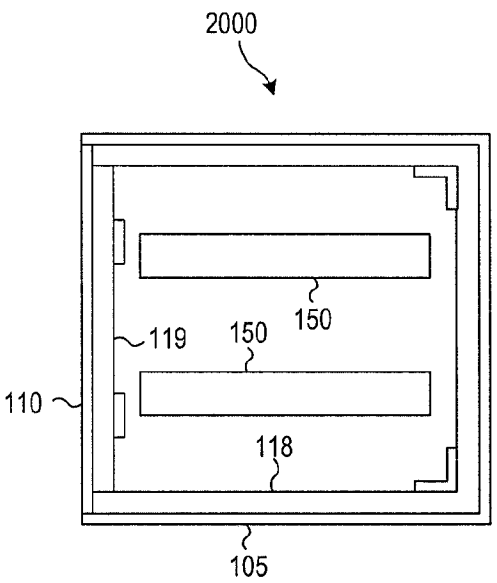
FIG. 20 is a cross-sectional top view of an air handling unit according to yet another disclosed embodiment.

FIG. 20 is a cross-sectional top view of an air handling unit 2000 according to yet another disclosed embodiment. As shown in FIG. 20, two flat connection elements 130 are provided, one at the front of the air handling unit 2000, and two bent connection elements 135 are provided, one at each back corner of the air handling unit 2000.

Figure 21:
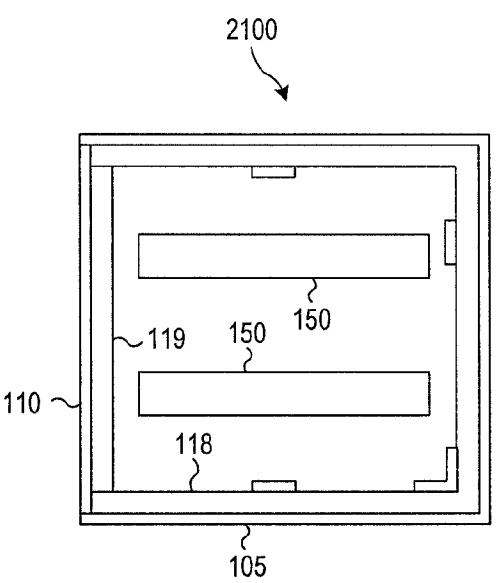
FIG. 21 is a cross-sectional top view of an air handling unit according to still another disclosed embodiment.

FIG. 21 is a cross-sectional top view of an air handling unit 2100 according to still another disclosed embodiment. As shown in FIG. 21 three flat connection elements 130 are provided, two on either side of the air handling unit 2100, and one at the back of the air handling unit 2100, and one bent connection element 135 is provided at one of the back corners of the air handling unit 2100. FIG. 21 shows that there is no need for the connection elements 130, 135 to be placed symmetrically, provided they give adequate support to the heat-exchanging coil 150 and the control shelf 122.

Figure 22:
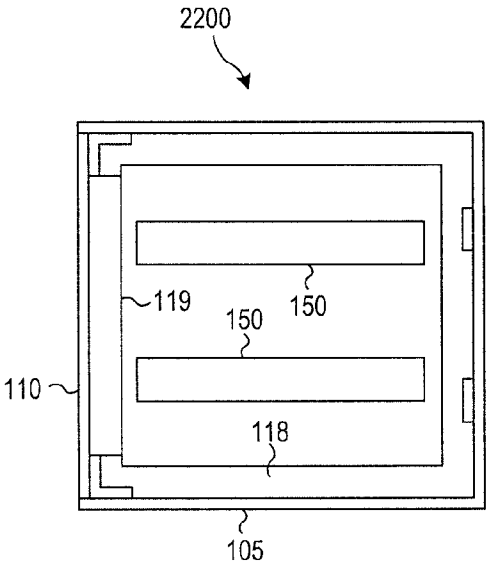
FIG. 22 is a cross-sectional top view of an air handling unit according to yet another disclosed embodiment.

FIG. 22 is a cross-sectional top view of an air handling unit 2200 according to yet another disclosed embodiment. As shown in FIG. 22, two bent connection elements 135 are provided, one at each of the front corners of the air handling unit 2200, and two flat connection elements 130 are provided, both at the back of the air handling unit 2200. In addition, FIG. 22 shows that it is possible for at least some part of the connection elements 130, 135 to run between the casing insulation 118 and the outer casing 105.

Figure 23:
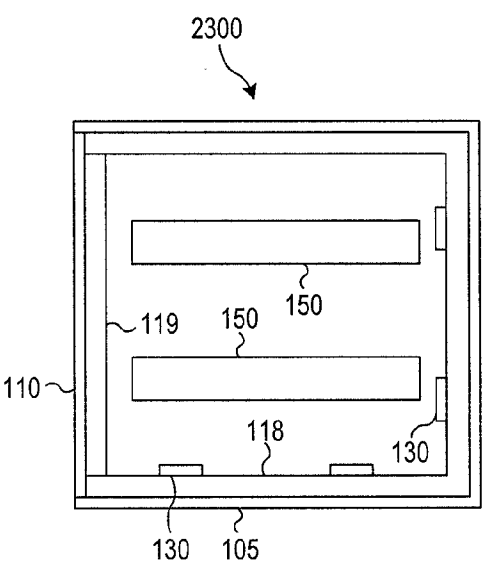
FIG. 23 is a cross-sectional top view of an air handling unit according to still another disclosed embodiment.

FIG. 23 is a cross-sectional top view of an air handling unit 2300 according to still another disclosed embodiment. As shown in FIG. 23, four flat connection elements 130 are provided, two at one side of the air handling unit 2300 and 2 at the back of the air handling unit 2300.

In addition, numerous other embodiments are possible using various combinations of flat and bent connection elements 130, 135 in various positions along the inside walls of the outer housing 105.

Cross-Braces

Figure 24:
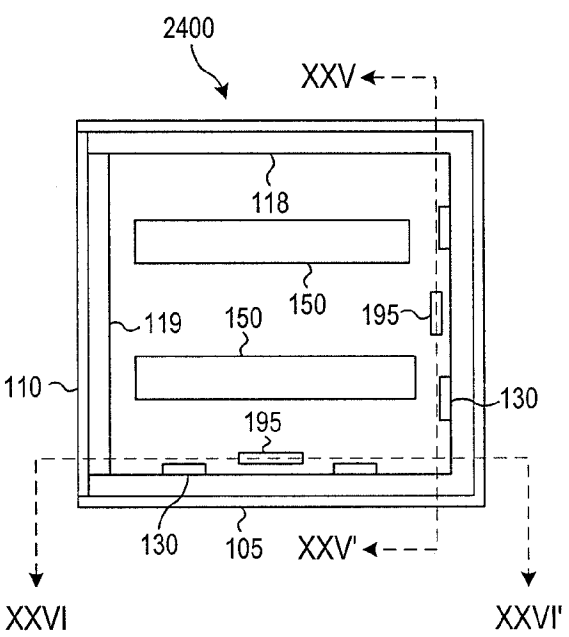
FIG. 24 is a cross-sectional top view of an air handling unit having cross-braces according to a disclosed embodiment.
Figure 25:
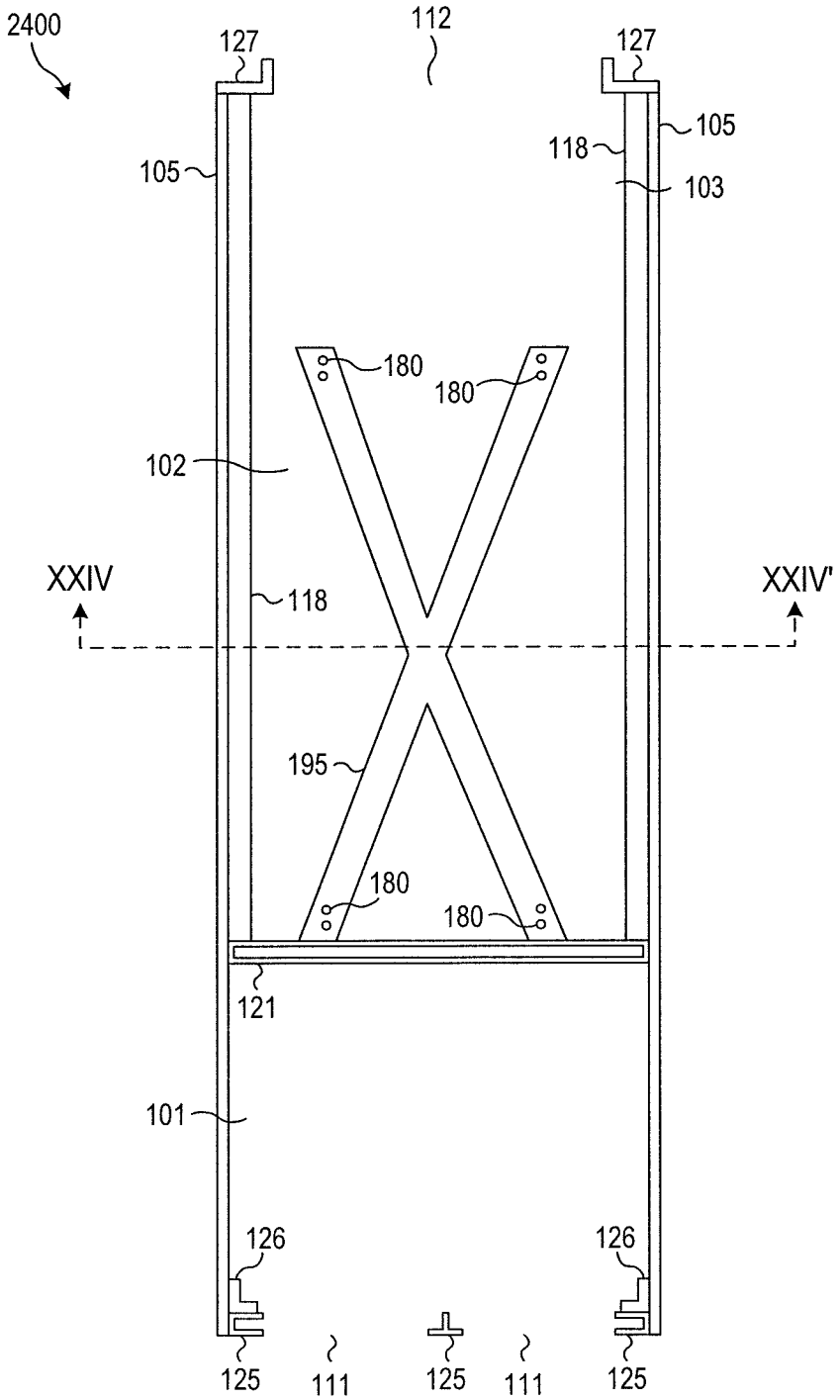
FIG. 25 is a cross-sectional front view of the air handling unit of FIG. 24 according to a disclosed embodiment.
Figure 26:
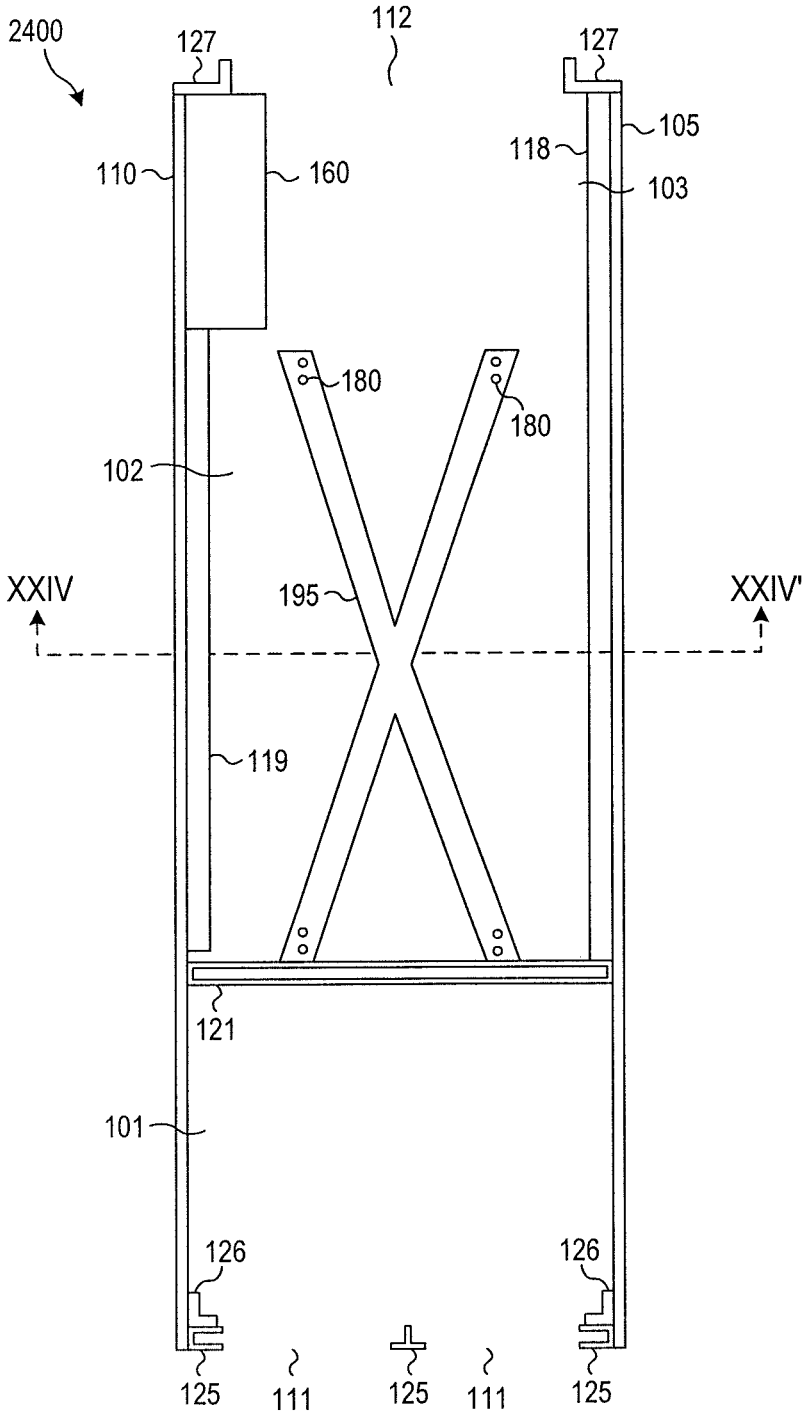
FIG. 26 is a cross-sectional side view of the air handling unit of FIG. 24 according to a disclosed embodiment.

In addition to connection elements 130, 135, the exemplary air handling units can also include cross-braces 195 to further support the connection elements 130, 135, and thereby the coil shelf 121 and the control shelf 122. FIGS. 24-26 disclose an embodiment in which cross-braces 195 are provided.

As shown in FIGS. 24-26, this embodiment includes an outer casing 105, an access panel 110, casing insulation 118, access insulation 119, first, second, and third braces 125, 126, 127, a coil shelf 121, a control shelf 122, a heat-exchanging coil 150, and an electronic control element 160. These elements are described above with respect to the embodiment of FIGS. 2-12. Their description will not be repeated here.

In the embodiment of FIGS. 24-26, four flat connection elements 130 are provided, two at one side of the air handling unit 2300 and two at the back of the air handling unit 2300. In addition a pair of cross-braces 195 are provided connecting the pair of connection elements 130 on each side of the outer casing 105.

FIG. 24 is a cross-sectional top view of an air handling unit 2400 having cross-braces 195 according to a disclosed embodiment. This cross-sectional view is along the line XIV-XIV' in FIGS. 25 and 26. FIG. 25 is a cross-sectional front view of the air handling unit 2400 of FIG. 24 according to a disclosed embodiment. This cross-sectional view is along the line XV-XV' in FIG. 24. FIG. 26 is a cross-sectional side view of the air handling unit 2400 of FIG. 24 according to a disclosed embodiment. This cross-sectional view is along the line XVI-XVI' in FIG. 24.

Although in FIGS. 24-26, the cross-braces 195 are shown as being connected to the top and bottom of the flat connection elements 130, in alternate embodiments they could be connected at different points along the flat connection elements. Furthermore, cross-braces could be used with bent connection elements 135, or in combination with both a flat connection element 130 and a bent connection element 135.

By employing cross-braces 195, this embodiment strengthens the support provided by connection elements 130, 135. This can allow for the use of fewer connection elements 130, 135, or can allow for connection elements 130, 135 to be placed in positions that might not otherwise provide an adequate support for the heat-exchanging coil 150 and the coil shelf 122.

Alternate Embodiments for the Connection Elements

Figure 27:
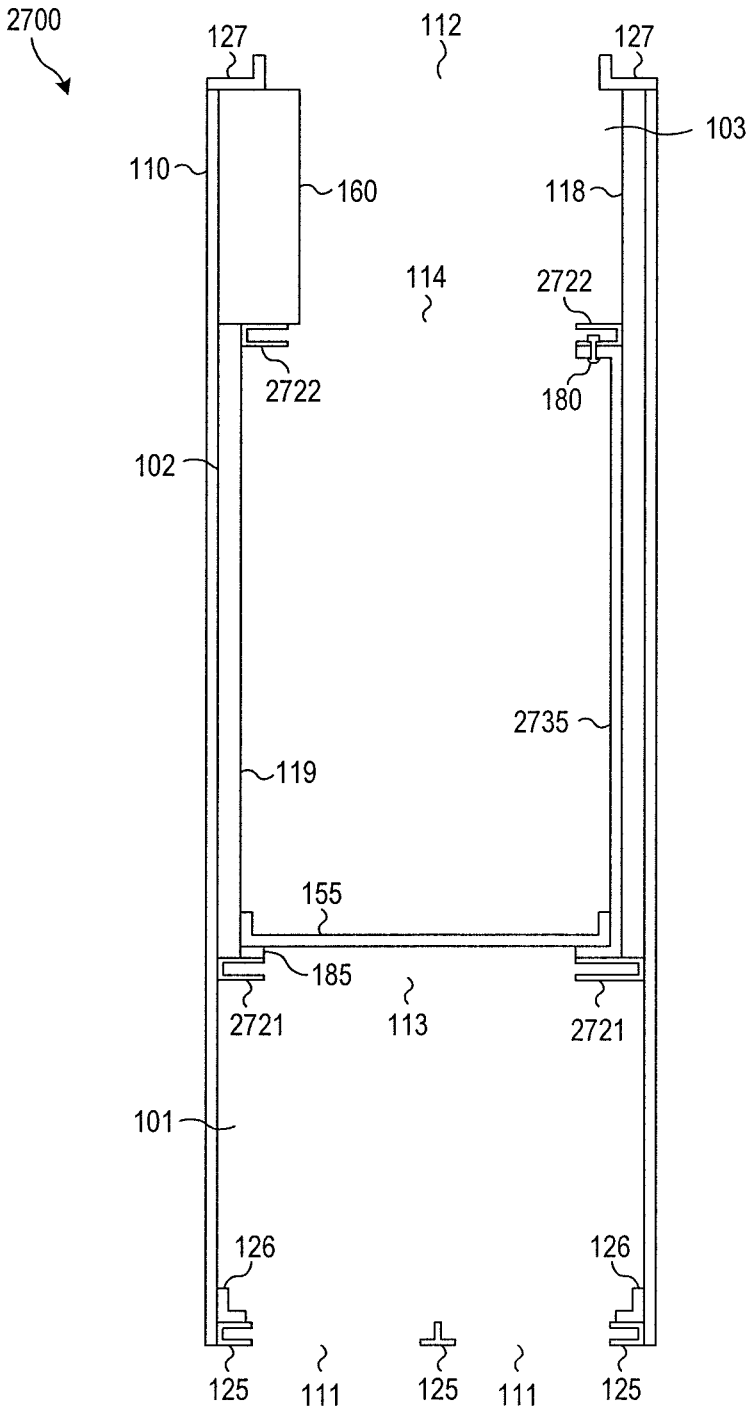
FIG. 27 is a cross-sectional side view of an air handling unit according to another disclosed embodiment.
Figure 28:
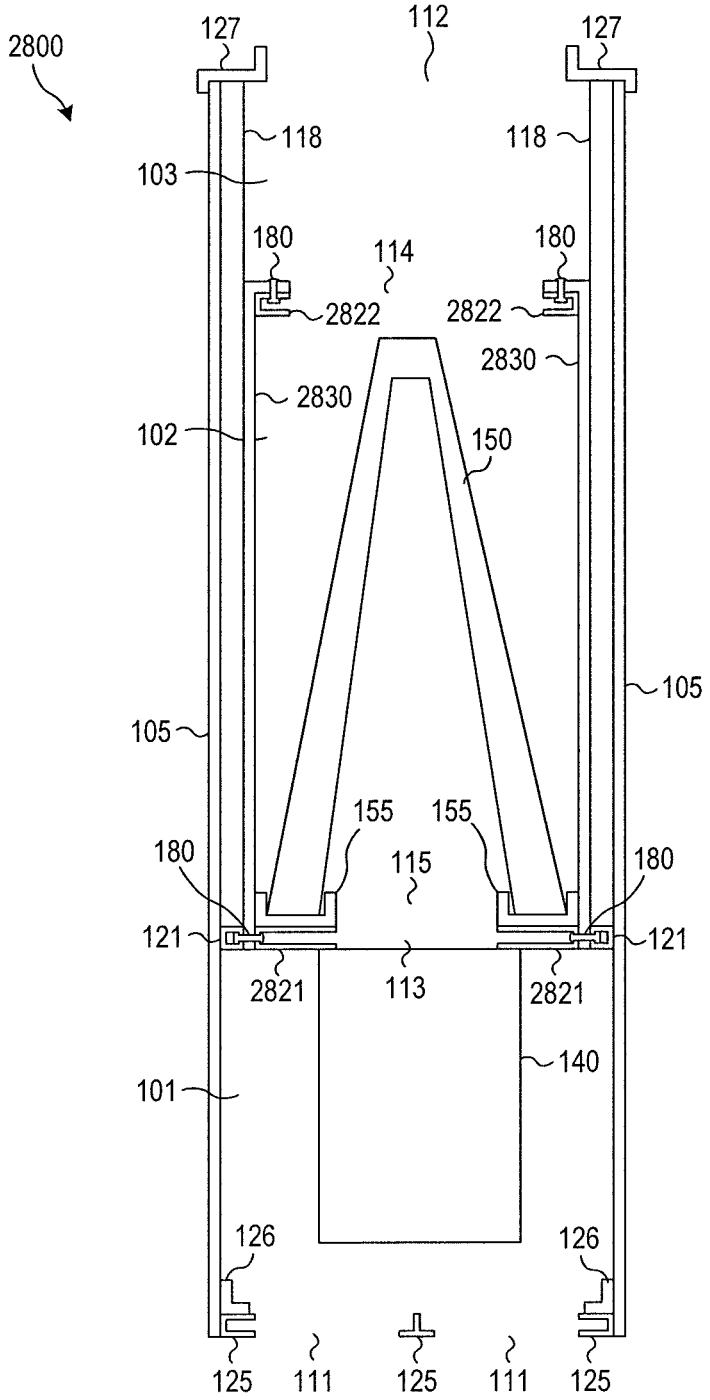
FIG. 28 is a cross-sectional front view of an air handling unit according to another disclosed embodiment.
Figure 29:
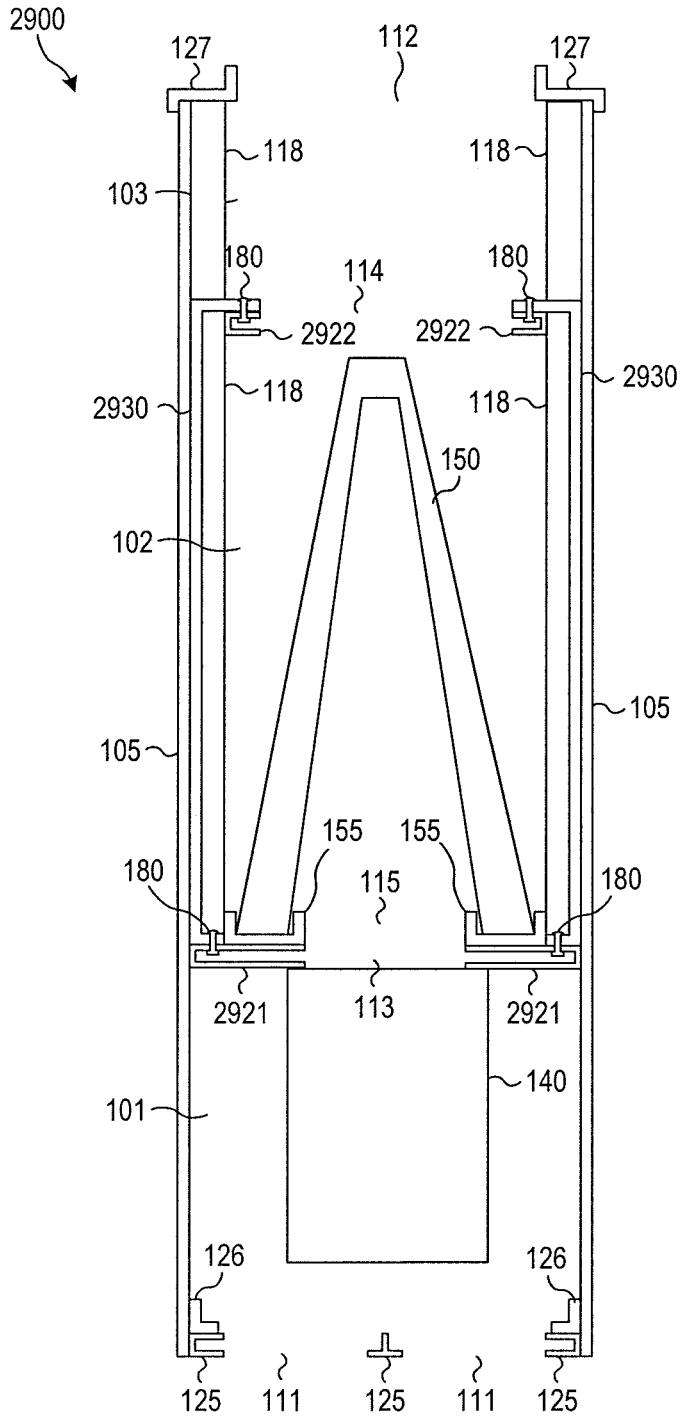
FIG. 29 is a cross-sectional front view of an air handling unit according to yet another disclosed embodiment.

Although the above disclosed embodiments show the use of connection elements 130, 135 that are connected on a side surface of the control shelf 122, and are bent at the bottom to connect to a top surface of the coil shelf 121, this is by way of example only. The connection elements 130, 135 can be shaped to connect to the coil shelf 121 and the control shelf 122 in different ways. In such embodiments, the coil shelf 121, and the control shelf 122 would be modified, as necessary, to provide the proper holes for attaching affixing elements 180. Furthermore, while the above embodiments place the insulation 118, 119 between the connection elements 130, 135 and the outer casing 105, this also is not required. FIGS. 27-29 illustrate just a few alternate embodiments of the connection elements 130, 135.

FIG. 27 corresponds generally to a side cross-sectional view along line V-V' in FIGS. 6-12, although in an alternate embodiment. FIGS. 28 and 29 correspond generally to a front cross-sectional view along the line II-II' in FIGS. 6-12, although in alternate embodiments. As shown in FIGS. 27-29, these embodiments each include an outer casing 105, an access panel 110, casing insulation 118, access insulation 119, first, second, and third braces 125, 126, 127, an air blower 140 a heat-exchanging coil 150, a drain pan 155, and an electronic control element 160. These elements are described above with respect to the embodiment of FIGS. 2-12. Their description will not be repeated here.

FIG. 27 is a cross-sectional side view of an air handling unit 2700 according to another disclosed embodiment. As shown in FIG. 27, a bent connection element 2735 is bent at the bottom such that it can be affixed to a top surface of the coil shelf 2721, and is bent at the top such that it can be affixed to a bottom surface of the control shelf 2722. Furthermore, the bottom bend is pointed inward in this embodiment, rather than outward.

FIG. 28 is a cross-sectional front view of an air handling unit 2800 according to another disclosed embodiment. As shown in FIG. 28, flat connection elements 2830 are not bent at the bottom, but rather are configured to fit through a slot in the coil shelf 2821, where they are secured to the coil shelf 2821. In addition, the flat connection elements 2830 are bent inward at the top such that they can be affixed to a top surface of the control shelf 2822.

FIG. 29 is a cross-sectional front view of an air handling unit 2900 according to yet another disclosed embodiment. As shown in FIG. 29, flat connection elements 2930 are bent inward at the bottom to connect to a top surface of the coil shelf 2921, and are bent inward at the top to connect to a top surface of the control shelf 2922. Furthermore, the flat connection elements 2930 are placed such that they extend between the casing insulation 118 and the outer housing 105.

Numerous other configurations can be made by mixing the various modifications described above with respect to FIGS. 27-29. Furthermore, although FIG. 27 illustrates an alternate embodiment for a bent connection element 2735, and FIGS. 28 and 29 illustrate alternate embodiments for flat connection elements 2830, 2930, the teachings of these embodiments are equally applicable to modifications of both kinds of connection elements 130, 135.

The Coil and Control Shelves

Although in the embodiments above, the coil shelf 121 and the control shelf 122 are disclosed as being rectangular in shape, this is not a requirement. In alternate embodiments, these shelves 121, 122 can vary in shape.

Figure 30:
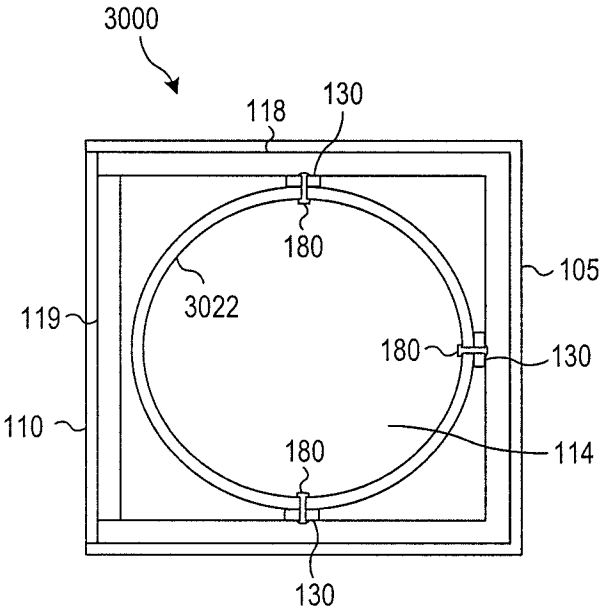
FIG. 30 is a cross-sectional top view of an air handling unit having a circular control shelf according to another disclosed embodiment.

FIG. 30 is a cross-sectional top view of an air handling unit 3000 having a circular control shelf 3022 according to a disclosed embodiment. As shown in FIG. 30, the circular control shelf 3022 can be attached to flat connection elements 130 along its perimeter. If the coil shelf 121 is rectangular, the circular shelf 3022 can be attached to flat connection elements 130 where the circular shelf 3022 is tangential to the walls of the outer casing 105, so that the flat connection elements 130 can be placed where they can be easily attached to the coil shelf 121.

Although in this embodiment, the control shelf 3022 (or a modified coil shelf 121) actually only has one side (i.e., the circumferential side of the circular shelf), references to the front, sides, and back sides of the shelf 3022 can nevertheless be made based on the general position of the shelf 3022. For example, the circumference of the control shelf 3022 in FIG. 30 can be broken up into four arcs, one representing a front surface of the circular control shelf 3022, two representing side surfaces of the circular control shelf 3022, and one representing a back surface of the circular control shelf 3022.

Figure 31:
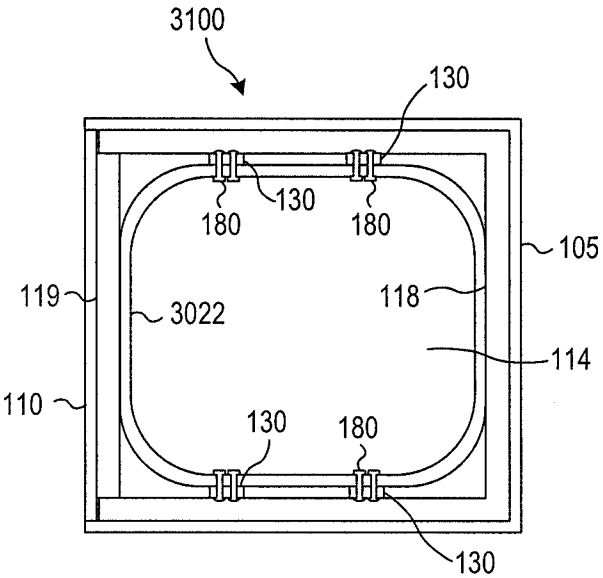
FIG. 31 is a cross-sectional top view of an air handling unit having a control shelf with rounded edges according to a disclosed embodiment.

FIG. 31 is a cross-sectional top view of an air handling unit 3100 having a control shelf 122 with rounded edges according to another disclosed embodiment. As shown in FIG. 31, the control shelf 122 is roughly rectangular, but with rounded edges. It can still be attached to the flat connection elements 130 along its periphery. Furthermore, it still retains a front surface, two side surfaces, and a back surface, despite the fact that its corners are rounded.

Although FIGS. 30 and 31 describe alternate shapes of the control shelf 122, the same is true for the coil shelf 121. In different embodiments, the coil shelf 121 and the control shelf 122 can have the same shape or different shapes, provided they can be properly connected by connection elements (in whatever form those connection elements take). In alternate embodiments, the coil shelf 121 and the control shelf 122 can have shapes that include polygonal shapes, circular or oval shapes, polygonal shapes with rounded edges, or even irregular shapes.

CONCLUSION

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled. The various circuits described above can be implemented in discrete circuits or integrated circuits, as desired by implementation.

What is claimed is:

1. An air handling unit, comprising:

an outer casing that defines an air passage for air passing through from a first opening on a first side of the outer casing to a second opening on a second side of the outer casing;

a first supporting member placed in the air passage and affixed to the outer casing by a first attachment element;

a heat exchanging coil attached to a surface of the first supporting member facing the second opening;

a second supporting member placed in the air passage such that the heat exchanging coil is located between the first supporting member and the second supporting member;

a third supporting member configured to connect the first supporting member to the second supporting member; and an insulation material located inside the air passage and adjacent to the outer casing, the insulation material being further located between the outer casing and the third supporting member, the insulation material being located adjacent to the outer casing at least between the first supporting member and the second opening, wherein the insulation material is unperforated between the first supporting member and the second opening.

2. An air handling unit, comprising:

an outer casing that defines an air passage for air passing from a first opening on a first side of the outer casing to a second opening on a second side of the outer casing;

a first supporting member placed in the air passage and affixed to the outer casing;

a heat-exchanging coil located in the air passage and affixed to a surface of the first supporting member facing the second opening;

a second supporting member placed in the air passage such that the heat-exchanging coil is located between the first supporting member and the second supporting member;

a third supporting member configured to connect the first supporting member and the second supporting member; and an insulation material located inside the air passage and adjacent to the outer casing at least between the first supporting member and the second opening, the insulation material being further located between the third supporting member and the outer casing, wherein the insulation material is unperforated between the first supporting member and the second opening.

3. The air handling unit, as recited in claim 2, wherein the third supporting member is formed of a material comprising one of steel, or aluminum.

4. The air handling unit, as recited in claim 2, wherein the second support member is not affixed to the outer casing.

5. The air handling unit, as recited in claim 2, wherein the casing insulation material is located only between the first supporting member and the second opening.

6. The air handling unit, as recited in claim 2, wherein the third supporting member is bent at an angle, the third supporting member is affixed to the first supporting member, proximate to an intersection of a first side of the first supporting member and a second side of the first supporting member, the first and second sides of the first supporting member being adjacent to each other, and the third supporting member is affixed to the second supporting member, proximate to an intersection of a first side of the second supporting member and a second side of the second supporting member, the first and second sides of the second supporting member being adjacent to each other.

7. The air handling unit, as recited in claim 2, further comprising a fourth supporting member configured to connect the first supporting member to the second supporting member.

8. The air handling unit, as recited in claim 7, wherein the third supporting member is affixed to the first supporting member, proximate to a first side of the first supporting member, and is affixed to the second supporting member, proximate to a first side of the second supporting member, the fourth supporting member is affixed to the first supporting member, proximate to a second side of the first supporting member, and is affixed to the second supporting member, proximate to a second side of the second supporting member, the first side of the first supporting member is formed opposite to the second side of the first supporting member, and the first side of the second supporting member is formed opposite to the second side of the second supporting member.

9. The air handling unit, as recited in claim 7, wherein the third supporting member is affixed to the first supporting member, proximate to a first side of the first supporting member, and is affixed to the second supporting member, proximate to a first side of the second supporting member, the fourth supporting member is affixed to the first supporting member, proximate to a second side of the first supporting member, and is affixed to the second supporting member, proximate to a second side of the second supporting member, the first side of the first supporting member is formed adjacent to the second side of the first supporting member, and the first side of the second supporting member is formed adjacent to the second side of the second supporting member.

10. The air handling unit, as recited in claim 7, further wherein the fourth supporting member is bent at an angle, the fourth supporting member is affixed to a third side of the first supporting member and a fourth side of the first supporting member, the third and fourth sides of the first supporting member being adjacent to each other, and the fourth supporting member is affixed to a third side of the second supporting member and a fourth side of the second supporting member, the third and fourth sides of the second supporting member being adjacent to each other.

11. The air handling unit, as recited in claim 7, further comprising:

a cross-brace connected between the third support member and the fourth support member.

12. An air handling unit, comprising:

an outer casing that defines an air passage for air passing from a first opening on a first side of the housing to a second opening on a second side of the outer casing;

a first shelf placed in the air passage and affixed to the outer casing;

a heat-exchanging coil located in the air passage and affixed to a surface of the first shelf facing the second opening;

a second shelf placed in the air passage such that the heat-exchanging coil is located between the first shelf and the second shelf;

a first rigid support strap configured to connect the first shelf to the second shelf; and an insulation material located inside the air passage and adjacent to the outer casing at least between the first shelf and the second opening, the insulation material being further located between the first rigid support strap and the outer casing, wherein the insulation material is unperforated between the coil shelf and the second opening.

13. The air handling unit, as recited in claim 12, wherein the first rigid support strap is formed of a material comprising one of steel, or aluminum.

14. The air handling unit, as recited in claim 12, wherein the second shelf is not affixed to the outer casing.

15. The air handling unit, as recited in claim 12, wherein the insulation material is located only between the first shelf and the second opening.

16. The air handling unit, as recited in claim 12, wherein the first rigid support strap is bent at an angle, the first rigid support strap is affixed to a first side of the first shelf and a second side of the first shelf, the first and second sides of the first shelf being adjacent to each other, and the first rigid support strap is affixed to a first side of the second shelf and a second side of the second shelf, the first and second sides of the second shelf being adjacent to each other.

17. The air handling unit, as recited in claim 12, further comprising a second rigid support strap configured to connect the first shelf to the second shelf.

18. The air handling unit, as recited in claim 17, wherein the first rigid support strap is affixed to the first shelf, proximate to a first side of the first shelf, and is affixed to the second shelf, proximate to a first side of the second shelf, the second rigid support strap is affixed to the first shelf, proximate to a second side of the first shelf, and is affixed to the second shelf, proximate to a second side of the second shelf, the first side of the first shelf is formed opposite to the second side of the first shelf, and the first side of the second shelf is formed opposite to the second side of the second shelf.

19. The air handling unit, as recited in claim 17, wherein the first rigid support strap is affixed to the first shelf, proximate to a first side of the first shelf, and is affixed to the second shelf, proximate to a first side of the second shelf, the second rigid support strap is affixed to the first shelf, proximate to a second side of the first shelf, and is affixed to the second shelf, proximate to a second side of the second shelf, the first side of the first shelf is formed adjacent to the second side of the first shelf, and the first side of the second shelf is formed adjacent to the second side of the second shelf.

20. The air handling unit, as recited in claim 17, further wherein the second rigid support strap is bent at an angle, the second rigid support strap is affixed to a third side of the first shelf and a fourth side of the first shelf, the third and fourth sides of the first shelf being adjacent to each other, and the second rigid support strap is affixed to a third side of the second shelf and a fourth side of the second shelf, the third and fourth sides of the second shelf being adjacent to each other.

21. The air handling unit, as recited in claim 17, further comprising:

a cross-brace connected between the first rigid support strap and the second rigid support strap.

* * * * *